US011299918B2

(12) United States Patent
Yamane et al.

(10) Patent No.: US 11,299,918 B2
(45) Date of Patent: Apr. 12, 2022

(54) VEHICLE DOOR OPENING/CLOSING DEVICE

(71) Applicant: AISIN CORPORATION, Kariya (JP)

(72) Inventors: Ryohei Yamane, Takahama (JP); Toshio Machida, Toyota (JP); Junji Yamaguchi, Chiryu (JP); Keisuke Matsumoto, Anjo (JP); Satoshi Takeno, Okazaki (JP); Yasuhiro Nagaya, Nishio (JP)

(73) Assignee: AISIN CORPORATION, Kariya (JP)

( * ) Notice: Subject to any disclaimer, the term of this patent is extended or adjusted under 35 U.S.C. 154(b) by 619 days.

(21) Appl. No.: 16/204,218

(22) Filed: Nov. 29, 2018

(65) Prior Publication Data

US 2019/0186176 A1 Jun. 20, 2019

(30) Foreign Application Priority Data

Dec. 20, 2017 (JP) ..... JP2017-244334

(51) Int. Cl.

| | |
|---|---|
| ***E05B 81/16*** | (2014.01) |
| ***E05B 83/40*** | (2014.01) |
| ***E05B 81/20*** | (2014.01) |
| ***E05C 3/12*** | (2006.01) |

(Continued)

(52) U.S. Cl.

CPC ..... *E05B 81/20* (2013.01); *E05B 81/16* (2013.01); *E05B 83/40* (2013.01); *E05C 3/12* (2013.01); *E05B 79/20* (2013.01); *E05B 81/06* (2013.01); *Y10S 292/62* (2013.01)

(58) Field of Classification Search

CPC ..... Y10S 292/62; E05B 81/16; E05B 81/20; E05B 83/40; E05B 79/20

See application file for complete search history.

(56) References Cited

U.S. PATENT DOCUMENTS 5,718,465 A * 2/1998 Dowling ..... E05B 65/0841 292/216
5,893,593 A * 4/1999 Dowling ..... E05B 83/36 292/336.3

(Continued)

FOREIGN PATENT DOCUMENTS

FR 3054851 A1 * 2/2018 ..... E05B 83/40
JP 2009127210 A 6/2009

(Continued)

*Primary Examiner* — Carlos Lugo
(74) *Attorney, Agent, or Firm* — Buchanan Ingersoll & Rooney PC

(57) ABSTRACT

A vehicle door opening/closing device includes: door lock devices each installed in a door and including a latch mechanism and an open lever capable of transmitting a releasing operation force to the latch mechanism; a fully closing lock releasing member rotatably provided in the door and rotating based on the releasing operation force; cables whose both terminals are connected to the open levers and the fully closing lock releasing member and causing the open levers to rotate to a releasing operation positions from an initial positions; and lost motion mechanisms at least one of which is disposed on the fully closing lock releasing member side of the cables and that, when one of the open levers is bound at the releasing operation position, allow the remainder of the open levers to return to the initial position.

19 Claims, 12 Drawing Sheets

(51) Int. Cl.
*E05B 79/20* (2014.01)
*E05B 81/06* (2014.01)

(56) References Cited

U.S. PATENT DOCUMENTS 6,135,513 A * 10/2000 Hamada ..... E05B 77/26 292/201
6,561,557 B2 * 5/2003 Choi ..... E05B 83/40 292/336.3
7,441,816 B2 * 10/2008 Watanabe ..... E05B 77/26 292/216
7,488,014 B2 * 2/2009 Nozawa ..... E05B 81/06 292/201
7,931,312 B2 * 4/2011 Mochizuki ..... E05B 81/46 292/216
8,376,417 B2 * 2/2013 Machida ..... E05B 65/08 292/216
8,613,160 B2 * 12/2013 Matsumoto ..... E05B 83/40 49/279
8,789,861 B2 * 7/2014 Takayanagi ..... E05B 77/265 292/218
8,894,103 B2 * 11/2014 Shibayama ..... E05B 81/14 292/201
8,967,680 B2 * 3/2015 Yokomori ..... E05F 15/603 292/201
9,556,656 B2 1/2017 Machida et al.
9,631,404 B2 * 4/2017 Takagi ..... E05B 77/32
9,670,700 B2 * 6/2017 Hanaki ..... E05B 81/20
9,920,556 B2 * 3/2018 Byun ..... E05B 79/20
9,938,760 B2 * 4/2018 Makino ..... E05B 81/20
9,970,220 B2 * 5/2018 Hiramoto ..... E05B 83/40
10,385,593 B2 * 8/2019 Machida ..... E05B 81/16
10,597,907 B2 * 3/2020 Yamashita ..... E05B 81/64
10,787,843 B2 * 9/2020 Shibayama ..... E05B 85/243
2005/0236847 A1 * 10/2005 Taniyama ..... E05B 81/14 292/216
2008/0105011 A1 * 5/2008 Machida ..... E05B 81/20 70/237
2015/0204113 A1 7/2015 Machida et al.

FOREIGN PATENT DOCUMENTS

JP 2014066082 A 4/2014
JP 2016104951 A 6/2016

* cited by examiner

FIG.12
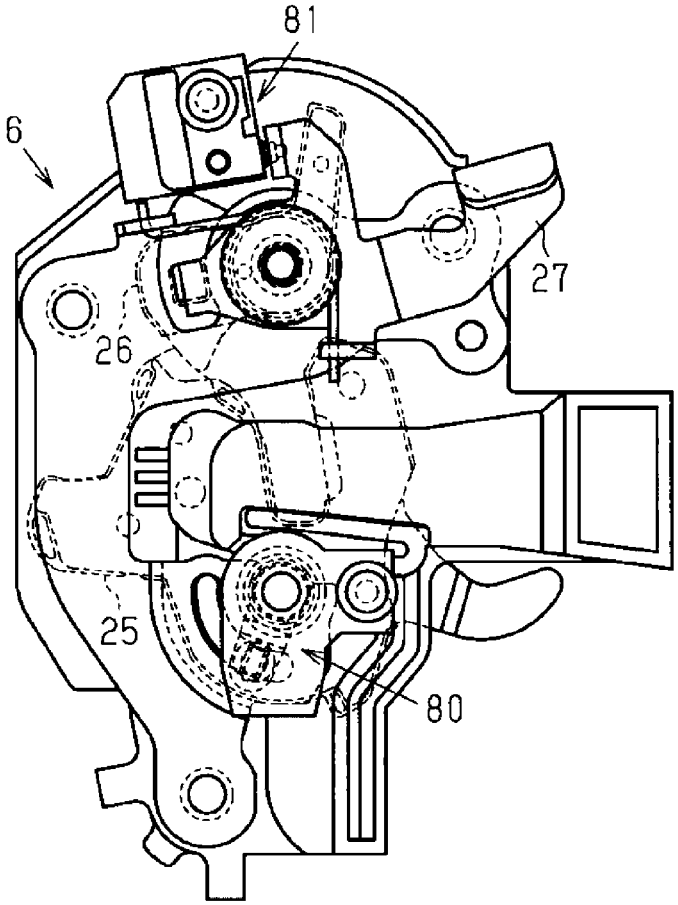
FIG.13
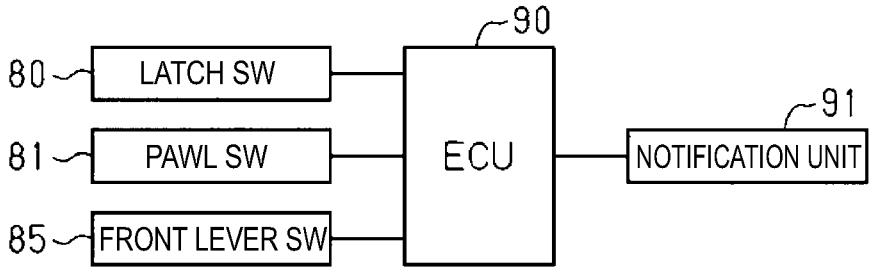
FIG.14
| | NORMAL | ABNORMAL |
|---|---|---|
| LATCH SW | OFF | OFF |
| PAWL SW | OFF | OFF |
| FRONT LEVER SW | OFF | ON |

VEHICLE DOOR OPENING/CLOSING DEVICE

CROSS REFERENCE TO RELATED APPLICATIONS

This application is based on and claims priority under 35 U.S.C. § 119 to Japanese Patent Application 2017-244334, filed on Dec. 20, 2017, the entire contents of which are incorporated herein by reference.

TECHNICAL FIELD

The disclosure relates to a vehicle door opening/closing device.

BACKGROUND DISCUSSION

In the related art, various vehicle door opening/closing devices have been proposed (for example, JP 2014-66082A, JP 2016-104951A, or like). Such a vehicle door opening/closing device is provided with a plurality of door lock devices (front side door lock device and rear side door lock device) installed in a vehicle door. Each of the plurality of door lock devices is provided with a latch mechanism that can hold the door in a closed state and an open lever that can transmit a releasing operation force to a latch mechanism in accordance with rotation. In addition, the vehicle door opening/closing device is provided with a remote control device (remote controller) installed in the door. The remote control device is provided with a fully closing lock releasing lever that can be linked to a vehicle internal operation handle, a vehicle external operation handle, and a release actuator. In addition, the fully closing lock releasing lever is connected to each of the open levers of the plurality of door lock devices via cables. When a releasing operation force is applied to any of the vehicle internal operation handle and the vehicle external operation handle or the release actuator generates a releasing operation force, the fully closing lock releasing lever rotates such that all of the cables are pulled toward the remote control device. In accordance with the above-described operation, all of the open levers of the plurality of door lock devices are rotated such that the releasing operation force is transmitted to the latch mechanisms. Accordingly, the door that is held in the closed state by all of the latch mechanisms of the plurality of door lock devices is released.

Meanwhile, in such a vehicle door opening/closing device, rotation of the fully closing lock releasing lever is interlocked with rotation of all of the open levers of the plurality of door lock devices via the cables. Therefore, when the open lever of any one of the plurality of door lock devices is stuck at a rotation position from which the releasing operation force is transmitted (hereinafter, referred to as "releasing operation position") due to rust or the like, the corresponding cable is pressed so that the fully closing lock releasing lever cannot return to an original position from a posture at that time. Accordingly, the remainder of the open levers of the plurality of door lock devices are pulled by the corresponding cables such that the open levers are held at releasing operation positions.

Accordingly, the latch mechanisms of all of the plurality of door lock devices become not able to hold the door in the closed state.

Thus, a need exists for a vehicle door opening/closing device which is not susceptible to the drawback mentioned above.

SUMMARY

A vehicle door opening/closing device according to an aspect of the disclosure includes: a plurality of door lock devices each of which is installed in a door of a vehicle and includes a latch mechanism that is capable of holding the door in a closed state and an open lever that is capable of transmitting a releasing operation force to the latch mechanism when the open lever rotates from an initial position to a releasing operation position, the releasing operation force being a force that releases the door held by the latch mechanism; a fully closing lock releasing member that is rotatably provided in the door while being linked to an operation handle and that rotates based on the releasing operation force applied to the operation handle; a plurality of cables whose both terminals are connected to the open levers of the plurality of door lock devices and the fully closing lock releasing member and that cause the open levers to rotate to the releasing operation positions from the initial positions when the fully closing lock releasing member rotates; and a plurality of lost motion mechanisms at least one of which is disposed on the fully closing lock releasing member side of the plurality of cables and that, when one of the open levers of the plurality of door lock devices is bound at the releasing operation position, allow the remainder of the open levers of the plurality of door lock devices to return to the initial position.

A vehicle door opening/closing device according to another aspect of the disclosure includes: a plurality of door lock devices each of which is installed in a door of a vehicle and includes a latch mechanism that is capable of holding the door in a closed state and an open lever that is capable of transmitting a releasing operation force to the latch mechanism when the open lever rotates from an initial position to a releasing operation position, the releasing operation force being a force that releases the door held by the latch mechanism; a fully closing lock releasing member that is rotatably provided in the door while being linked to an operation handle and that rotates based on the releasing operation force applied to the operation handle; a plurality of cables whose both terminals are connected to the open levers of the plurality of door lock devices and the fully closing lock releasing member and that cause the open levers to rotate to the releasing operation positions from the initial positions when the fully closing lock releasing member rotates; and a lost motion mechanism that is disposed on the fully closing lock releasing member side of the plurality of cables and that, when one of the open levers of the plurality of door lock devices is bound at the releasing operation position, allows the remainder of the open levers of the plurality of door lock devices to return to the initial position.

BRIEF DESCRIPTION OF THE DRAWINGS

The foregoing and additional features and characteristics of this disclosure will become more apparent from the following detailed description considered with the reference to the accompanying drawings, wherein:

FIG. 12 is a front view illustrating an electrical configuration of the rear lock of the vehicle door opening/closing device according to the first embodiment;

FIG. 13 is a block diagram illustrating an electrical configuration of the vehicle door opening/closing device according to the first embodiment;

FIG. 14 is a list diagram for explaining the way in which the vehicle door opening/closing device according to the first embodiment is controlled;

DETAILED DESCRIPTION

First Embodiment

Hereinafter, a first embodiment of a vehicle door opening/closing device will be described. In the following description, a front-rear direction of a vehicle will be referred to as "front-rear direction" and an upper side and a lower side in a vehicle height direction will be referred to as "upper side" and "lower side", respectively.

Figure 1:
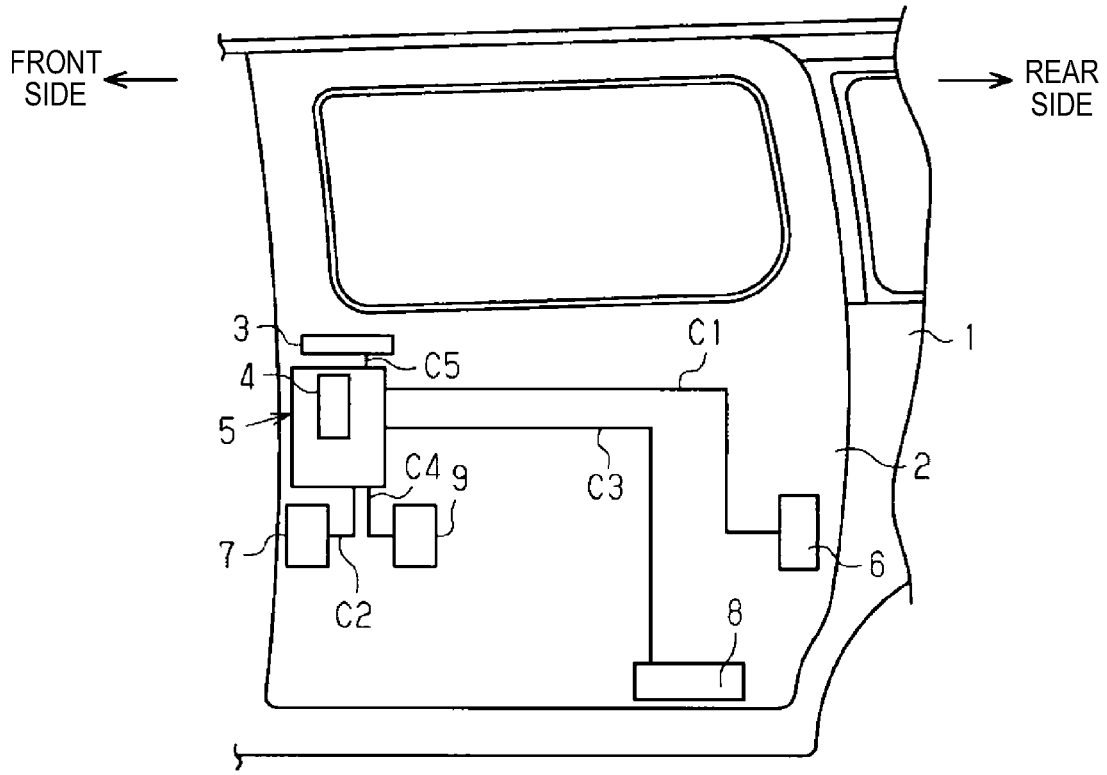
FIG. 1 is a schematic view illustrating a structure of a vehicle door opening/closing device according to a first embodiment.

As illustrated in FIG. 1, a slide door 2 as a door is supported onto a side portion of a body 1 of a vehicle via an appropriate supporting member (not shown) such that the slide door 2 can move in the front-rear direction. The slide door 2 opens and closes an opening for boarding and alighting by moving in the front-rear direction.

A vehicle external operation handle 3 as an operation handle that extends in the front-rear direction is swingably connected to a front side portion of an outer surface of the slide door 2. Meanwhile, a vehicle internal operation handle 4 as an operation handle that extends in the vehicle height direction is swingably connected to a front side portion of an inner surface of the slide door 2.

In addition, a remote controller 5 linked to the vehicle external operation handle 3 and the vehicle internal operation handle 4 is installed in an internal space of the slide door 2.

Furthermore, a rear lock 6 as a door lock device that holds the slide door 2 in a fully-closed state or a half-closed state (closed state) by being engaged with the body 1 side and a front lock 7 as a door lock device that holds the slide door 2 in the fully-closed state (closed state) are installed in the internal space of the slide door 2. In addition, a fully opening door lock device 8 that holds the slide door 2 in a fully-opened state by being engaged with the body 1 side is installed in the internal space of the slide door 2.

The rear lock 6 and the front lock 7 are respectively linked to the remote controller 5 via release cables C1 and C2 as a plurality of cables and the fully opening door lock device 8 is linked to the remote controller 5 via a release cable C3.

Here, each of the vehicle external operation handle 3 and the vehicle internal operation handle 4 transmits a releasing operation force applied thereto to the remote controller 5. The remote controller 5 transmits the releasing operation force to the front lock 7, the rear lock 6, and the fully opening door lock device 8 via the release cables C1 to C3. The rear lock 6, the front lock 7, and the fully opening door lock device 8 release the slide door 2 held as described above when the releasing operation force is transmitted thereto. Accordingly, the slide door 2 enters an openable state or a closable state.

A release actuator 9 is installed in the internal space of the slide door 2. The release actuator 9 is linked to the remote controller 5 via a cable C4 and a releasing operation force generated by the release actuator 9 is transmitted to the remote controller 5 via the cable C4. The remote controller 5 transmits the releasing operation force to the front lock 7, the rear lock 6, and the fully opening door lock device 8 via the release cables C1 to C3. That is, the releasing operation force generated by the release actuator 9 also causes the slide door 2 to enter the openable state or the closable state.

Figure 2:
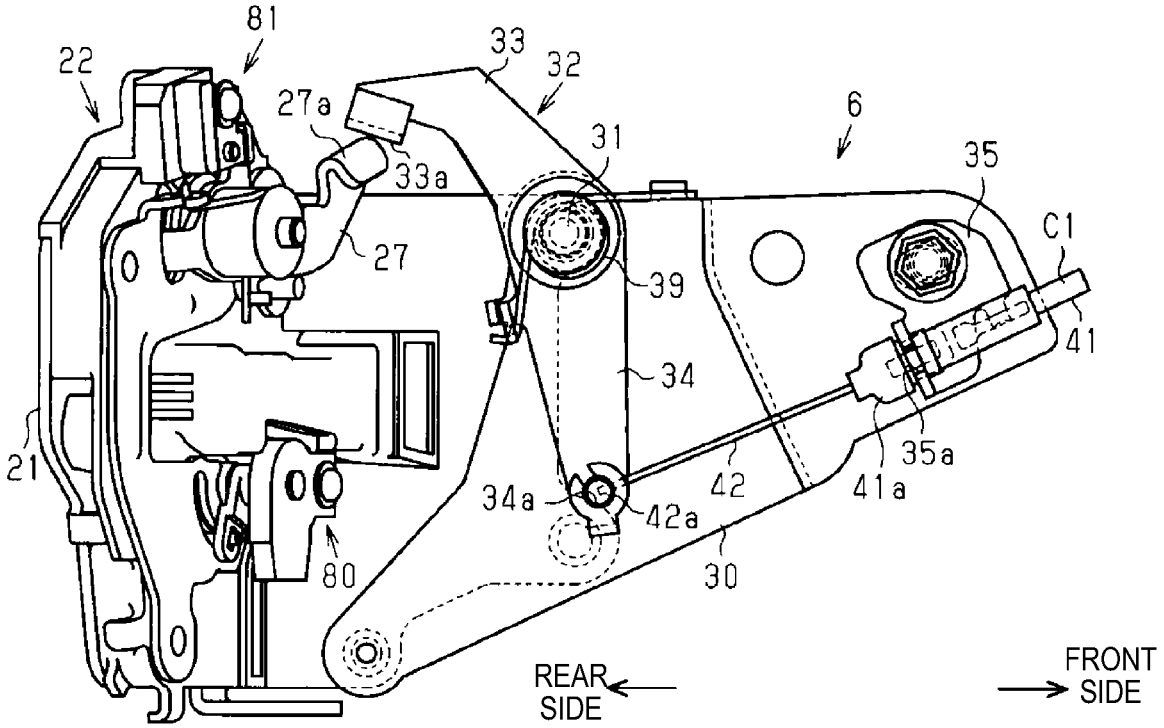
FIG. 2 is a side view illustrating a structure of a rear lock of the vehicle door opening/closing device according to the first embodiment.
Figure 3:
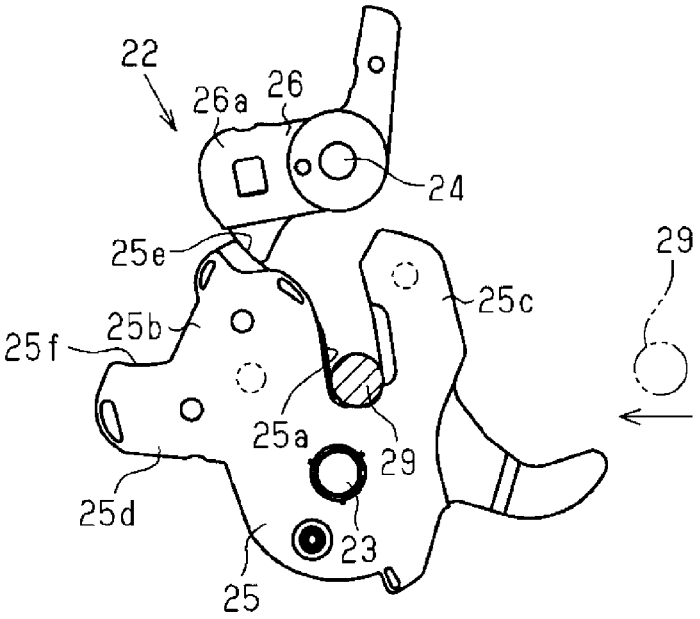
FIG. 3 is a front view illustrating a structure of a latch mechanism of the vehicle door opening/closing device according to the first embodiment.

As illustrated in FIG. 2, the rear lock 6 is provided with a base plate 21 that extends along a rear end surface of the slide door 2, is fastened to the rear end surface, and is formed of a metal plate and the rear lock 6 is provided with a latch mechanism 22 that is installed onto the base plate 21. As illustrated in FIG. 3, the latch mechanism 22 is provided with a latch 25 and a pawl 26 that are respectively connected to a pair of rotation shafts 23 and 24 such that the latch 25 and the pawl 26 are integrally rotated with the pair of rotation shafts 23 and 24, the rotation shafts 23 and 24 being pivotally supported by the base plate 21 and being parallel to each other.

The latch 25 is formed with an approximately U-shaped engagement recess portion 25*a*. In addition, the latch 25 is formed with a first claw portion 25*b* and a second claw portion 25*c* on one side and the other side (counter-clockwise direction side and clockwise direction side in FIG. 3) respectively with the engagement recess portion 25*a* interposed therebetween. In addition, the latch 25 is formed with a third claw portion 25*d* that protrudes from an intermediate portion of the first claw portion 25*b* in a longitudinal direction. In a circumferential direction, an end surface of a distal end portion of the first claw portion 25*b* that faces the second claw portion 25*c* and an end surface of the third claw portion 25*d* that faces the first claw portion 25*b* are formed with a full latch engagement surface 25*e* and a half latch engagement surface 25*f*, respectively. The latch 25 is urged to rotate in the clockwise direction in the drawing when the other end of a latch urging spring (not shown), whose one end is latched to the base plate 21, is latched and the latch 25 is restricted from rotating in the clockwise direction and is held at a predetermined initial rotation position (hereinafter, referred to as "unlatching position") when the latch 25 abuts onto a latch stopper (not shown) installed onto the base plate 21.

Meanwhile, the pawl 26 is formed with an approximately hook-shaped engagement end portion 26*a* that protrudes from the rotation shaft 24 toward one side (left side in FIG. 3) in a radial direction of the rotation shaft 24. The pawl 26 is urged by a pawl urging spring (not shown) to rotate in the counter-clockwise direction in the drawing (that is, pawl 26 is urged such that engagement end portion 26*a* moves to lower side in drawing) and is held at a predetermined initial rotation position.

Here, a basic operation of the latch mechanism 22 will be described.

In a state where the slide door 2 is open, the engagement recess portion 25*a* of the latch 25 held at the unlatching position faces a striker 29 fixed to the body 1. That is, the engagement recess portion 25*a* opens a path which the striker 29 enters when the slide door 2 is closed. In addition, the engagement end portion 26*a* of the pawl 26 held at the predetermined initial rotation position is disposed above the third claw portion 25*d*. The state of the latch mechanism 22 at this time will be referred to as an unlatched state.

Next, the description will be made on an assumption that the striker 29 has entered the engagement recess portion 25*a* with the slide door 2 closed. At this time, an inner wall surface of the engagement recess portion 25*a* is pressed by the striker 29 and thus the latch 25 rotates in the counter-clockwise direction in the drawing against the latch urging spring and the rotation is restricted with the engagement end portion 26*a* engaged with the half latch engagement surface 25*f*. At this time, the slide door 2 is in a half-closed state in which the slide door 2 is engaged with the striker 29 in the engagement recess portion 25*a* such that the striker 29 is prevented from coming off. The state of the latch mechanism 22 at this time will be referred to as a half-latched state and the rotation position of the latch 25 at this time will be referred to as a half latch position.

Next, the description will be made on an assumption that the striker 29 has entered a deeper side in the engagement recess portion 25*a* with the slide door 2 closed more. At this time, the inner wall surface of the engagement recess portion 25*a* is pressed by the striker 29 and thus the latch 25 rotates in the counter-clockwise direction in the drawing against the latch urging spring and the rotation is restricted with the engagement end portion 26*a* engaged with the full latch engagement surface 25*e*, as illustrated in FIG. 3. At this time, the slide door 2 is in a fully-closed state in which the slide door 2 is engaged with the striker 29 in the engagement recess portion 25*a* such that the striker 29 is prevented from coming off. The state of the latch mechanism 22 at this time will be referred to as a fully-latched state and the rotation position of the latch 25 at this time will be referred to as a full latch position.

In addition, when the pawl 26 rotates in the clockwise direction in the drawing against the pawl urging spring in the half-latched state or the fully-latched state, the half latch engagement surface 25*f* or the full latch engagement surface 25*e* locked by the engagement end portion 26*a* is released. At this time, the latch 25 rotates in the clockwise direction in the drawing since the inner wall surface of the engagement recess portion 25*a* is pressed by the striker 29 leaving the inside of the engagement recess portion 25*a* as the slide door 2 starts to be opened due to a repulsive force or the like of a seal member, for example. In addition, the slide door 2 enters the openable state with the engagement recess portion 25*a* disengaged from the striker 29.

As illustrated in FIG. 2, the rear lock 6 is provided with a pawl driving lever 27 that is connected to the rotation shaft 24 such that the pawl driving lever 27 is integrally rotated with the rotation shaft 24. A distal end portion of the pawl driving lever 27 is curved to protrude upward and is formed with a pressed portion 27*a*. A direction in which the pawl driving lever 27 rotates such that the pressed portion 27*a* is moved downward coincides with a direction in which the pawl 26 rotates such that the pawl 26 is disengaged from the latch 25.

A base plate 30 that extends toward a vehicle front side and is formed of, for example, a metal plate is fastened to the base plate 21. The bale plate 30 is fastened to the slide door 2 separately from the base plate 21. In addition, an approximately columnar support pin 31 is fixed to the base plate 30 and an open lever 32 that is formed of, for example, a metal plate is pivotally supported by the support pin 31. From the open lever 32, an approximately bow-shaped first lever protruding piece 33 extends radially upward being centered on the support pin 31 and an arm-shaped second lever protruding piece 34 extends radially downward being centered on the support pin 31.

A distal end of the first lever protruding piece 33 is curved to protrude downward at a position above the pressed portion 27*a* of the pawl driving lever 27 and is formed with a pressing portion 33*a*. A distal end portion of the second lever protruding piece 34 is formed with an approximately circular latching hole 34*a* that penetrates the second lever protruding piece 34 in a thickness direction. The open lever 32 is held at a predetermined rotation position (hereinafter, referred to as "initial position") by a return spring 39 wound around the support pin 31, the pressing portion 33*a* being close to the pressed portion 27*a* when the open lever 32 is at the predetermined rotation position. When the open lever 32 rotates in the counter-clockwise direction in the drawing against an urging force of the return spring 39 up to a predetermined rotation position (hereinafter, referred to as "releasing operation position"), the pressing portion 33*a* presses the pressed portion 27*a* downward such that the slide door 2 that is held in the fully-closed state or the half-closed state (closed state) by the latch mechanism 22 is released.

A terminal of the release cable C1 is latched in the latching hole 34*a* of the open lever 32. That is, a support bracket 35 that is formed of, for example, a metal plate is attached to a front end portion of the base plate 30 and the support bracket 35 is formed with an approximately U-shaped groove-like cable locking portion 35*a* that communicates toward the latching hole 34*a*. Meanwhile, the release cable C1 is provided with a guide tube 41 that is routed between the remote controller 5 and the release cable C1 and an internal cable 42 that is inserted into the guide tube 41. In addition, a terminal 41*a* of the guide tube 41 is fitted into the cable locking portion 35*a* and an approximately columnar terminal 42*a* of the internal cable 42 exposed from the terminal 41*a* is inserted into and latched in the latching hole 34*a*. Accordingly, when the internal cable 42 is drawn into the guide tube 41, that is, when the internal cable 42 is pulled toward the remote controller 5 side, the open lever 32 rotates in the counter-clockwise direction in the drawing around the support pin 31 from the initial position to the releasing operation position. At this time, the slide door 2 that is held in the fully-closed state or the half-closed state (closed state) by the latch mechanism 22 is released and the slide door 2 enters the openable state as described above.

Thereafter, when the internal cable 42 drawn into the guide tube 41 is released, the open lever 32 returns to the initial position by being urged by the return spring 39. Accordingly, the pawl 26 rotates up to the initial rotation position along with the pawl driving lever 27 released from the pressing portion 33*a* of the open lever 32. It is a matter of course that the latch mechanism 22 has returned to the unlatched state at this time.

Figure 4:
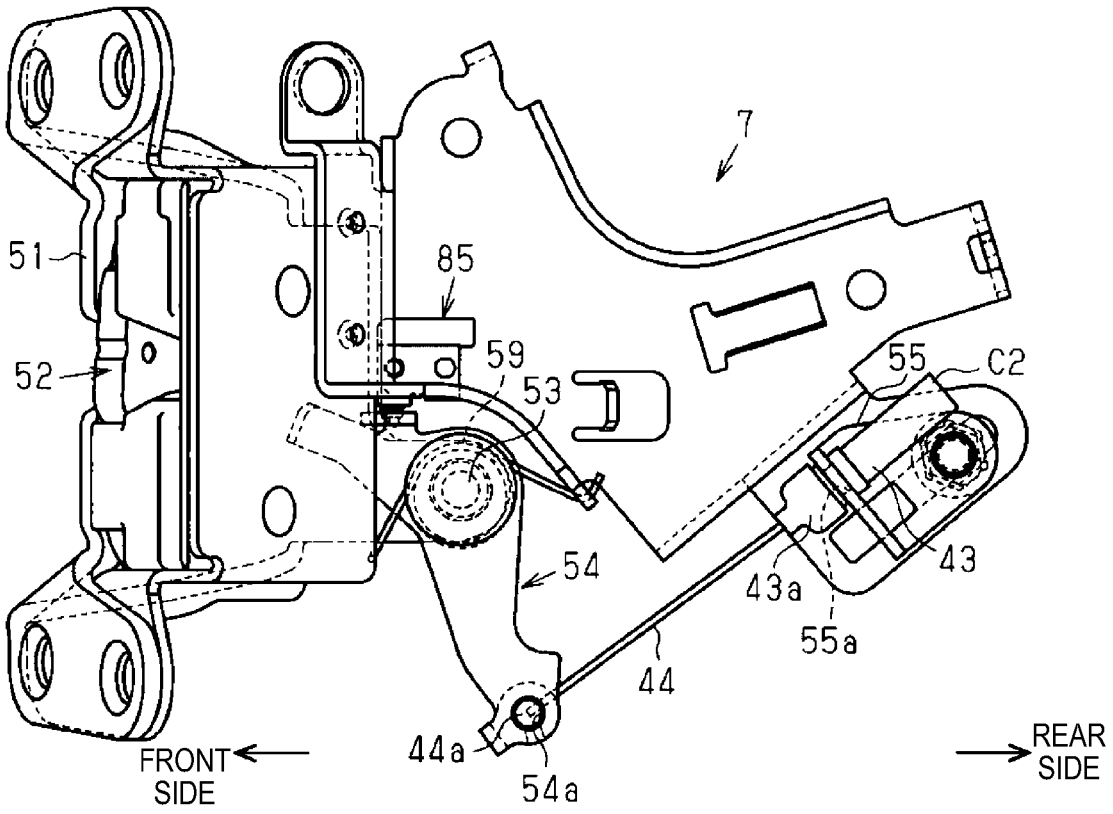
FIG. 4 is a side view illustrating a structure of a front lock of the vehicle door opening/closing device according to the first embodiment.

As illustrated in FIG. 4, the front lock 7 is also provided with a base plate 51, a latch mechanism 52, an open lever 54 that rotates in the counter-clockwise direction in the drawing around a support pin 53 from an initial position to a releasing operation position such that the slide door 2 that is held in the fully-closed state (closed state) by the latch mechanism 52 is released, and a return spring 59 that holds the open lever 54 at the initial position, as with the rear lock 6.

A terminal of the release cable C2 is latched in an approximately circular latching hole 54*a* of the open lever 54 that is equivalent to the latching hole 34*a*. That is, a support bracket 55 that is formed of, for example, a metal plate is attached to a rear end portion of the base plate 51 and the support bracket 55 is formed with an approximately U-shaped groove-like cable locking portion 55*a* that communicates toward the latching hole 54*a*. Meanwhile, the release cable C2 is provided with a guide tube 43 that is routed between the remote controller 5 and the release cable C2 and an internal cable 44 that is inserted into the guide tube 43. In addition, a terminal 43*a* of the guide tube 43 is fitted into the cable locking portion 55*a* and an approximately columnar terminal 44*a* of the internal cable 44 exposed from the terminal 43*a* is inserted into and latched in the latching hole 54*a*. Accordingly, when the internal cable 44 is drawn into the guide tube 43, that is, when the internal cable 44 is pulled toward the remote controller 5 side, the open lever 54 rotates in the counter-clockwise direction in the drawing around the support pin 53 from the initial position to the releasing operation position. At this time, the slide door 2 that is held in the fully-closed state (closed state) by the latch mechanism 52 is released and the slide door 2 enters the openable state as described above, as with the case of the latch mechanism 22.

Thereafter, when the internal cable 44 drawn into the guide tube 43 is released, the open lever 54 returns to the initial position by being urged by the return spring 59. At this time, the latch mechanism 52 returns to the unlatched state as with the latch mechanism 22.

The fully opening door lock device 8 also has a structure as described above and the slide door 2 enters the closable state when the release cable C3 is pulled toward the remote controller 5 side.

Next, the remote controller 5 will be described.

Figure 5:
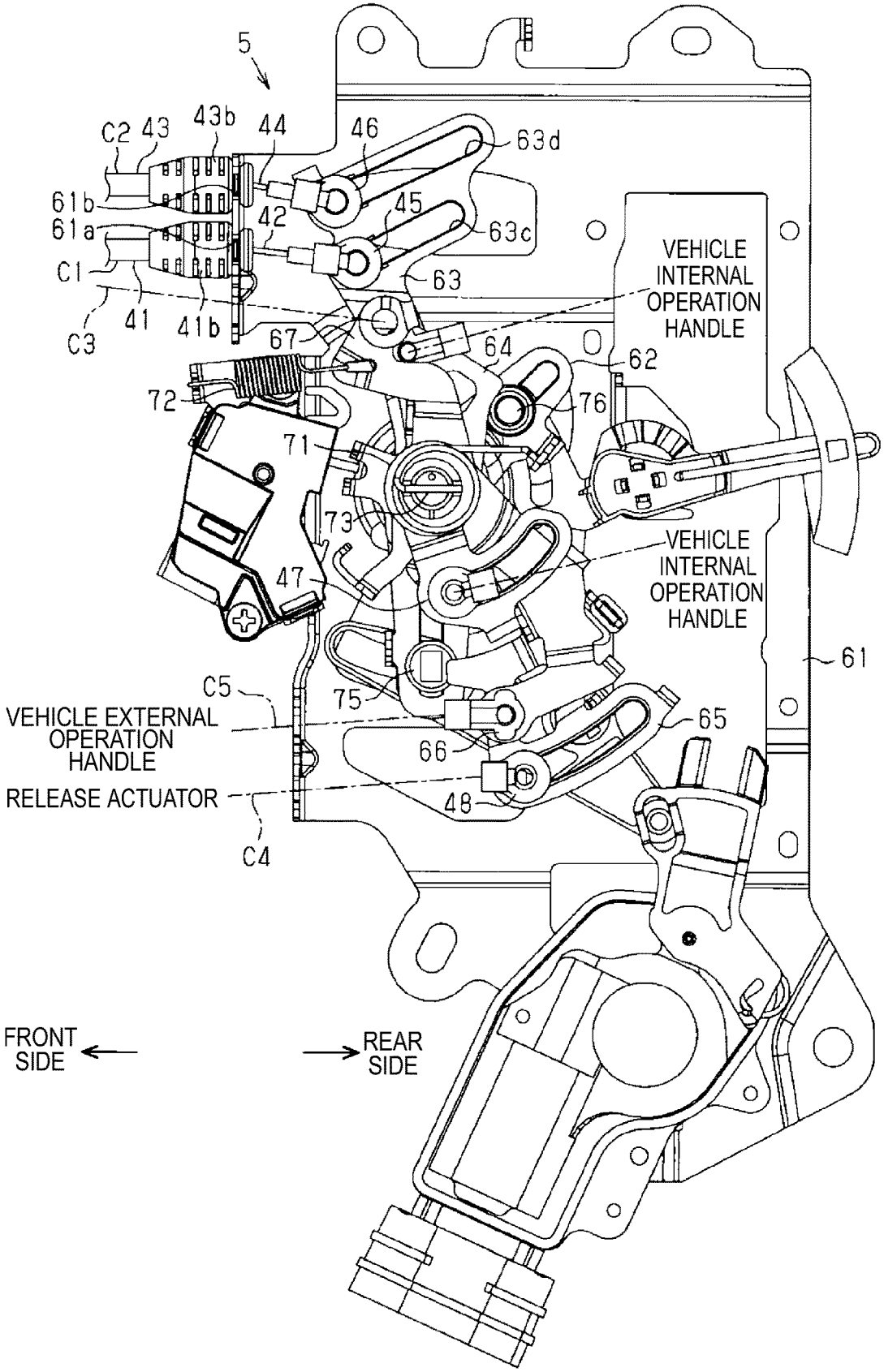
FIG. 5 is a side view illustrating a structure of a remote controller of the vehicle door opening/closing device according to the first embodiment.
Figure 6:
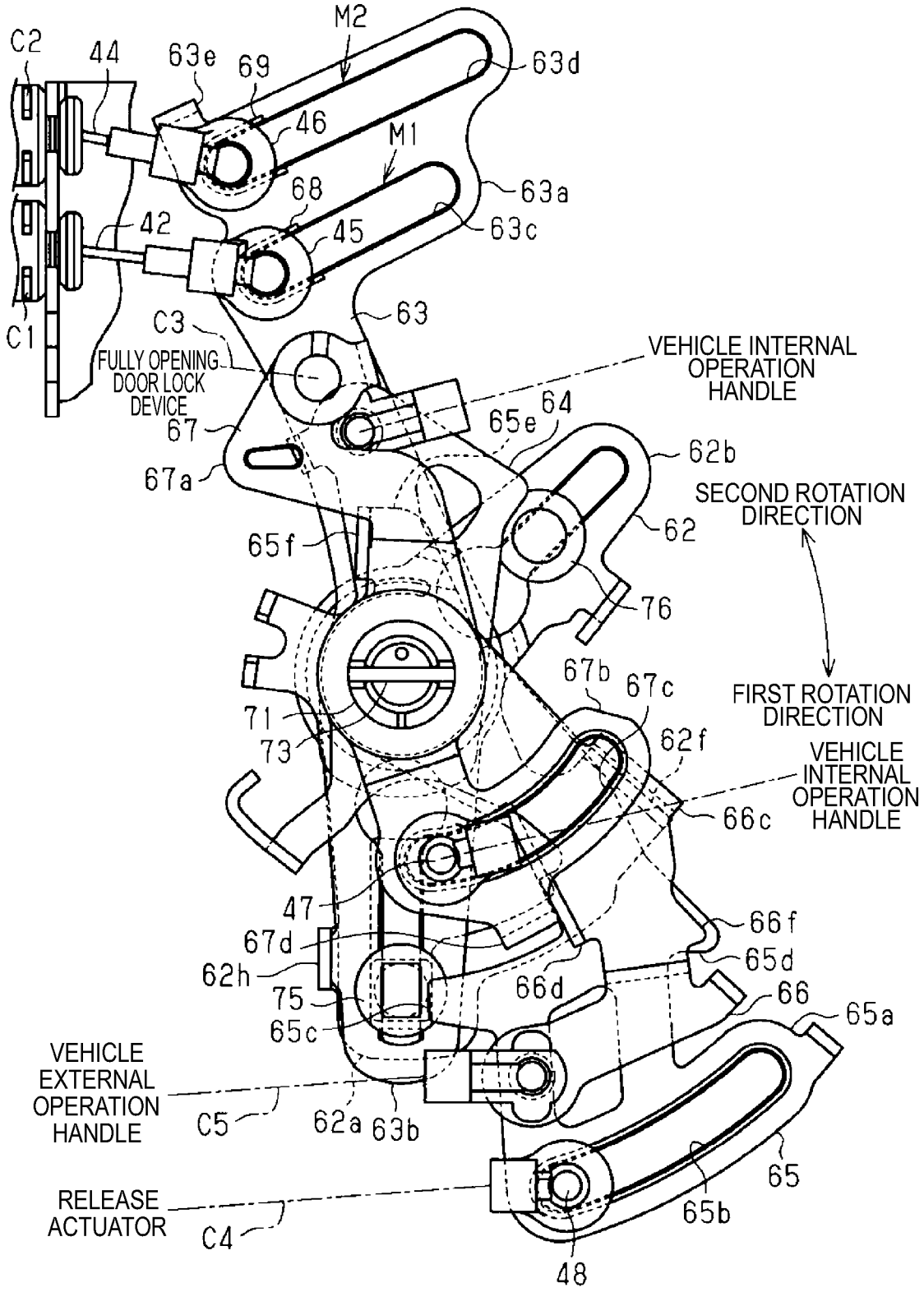
FIG. 6 is a side view illustrating a structure of the remote controller of the vehicle door opening/closing device according to the first embodiment.

As illustrated in FIGS. 5 and 6, the remote controller 5 is configured to include a base plate 61 that extends along the slide door 2, is fastened to the slide door 2, and is formed of, for example, a metal plate, a relay lever 62, a fully closing lock releasing lever 63 as a fully closing lock releasing member, a vehicle internal handle connection lever 64, a power connection lever 65, a vehicle external handle connection lever 66, and a fully opening lock releasing lever 67.

The base plate 61 is formed with a pair of approximately U-shaped groove-like upper and lower cable locking portions 61*a* and 61*b* that communicates in an approximately front-rear direction at a left upper end in the drawing. The relay lever 62, the fully closing lock releasing lever 63, the vehicle internal handle connection lever 64, the power connection lever 65, the vehicle external handle connection lever 66, and the fully opening lock releasing lever 67 are stacked to be arranged in this order from a side close to the base plate 61 and are rotatably supported by a common support shaft 71 that is erected from the base plate 61.

The fully opening lock releasing lever 67 is provided with a pair of lever protruding pieces 67*a* and 67*b*, the lever protruding pieces 67*a* and 67*b* projecting in opposite radial directions centered on the support shaft 71. One lever protruding piece 67*a* is connected to the fully opening door lock device 8 via the release cable C3 at a distal end portion thereof.

A distal end portion of the other lever protruding piece 67*b* extends in a second rotation direction (counter-clockwise direction in FIG. 6), which is opposite to a first rotation direction (clockwise direction in FIG. 6) around the support shaft 71, and has an approximately L-shape. In addition, at a distal end of the lever protruding piece 67*b*, an interlock abutting piece 67*d* is bent and raised up toward the vehicle external handle connection lever 66 side (back side in FIG. 6) at the right angle.

In addition, an elongated hole 67*c* that has an approximately arc shape centered on the support shaft 71 is formed to penetrate the distal end portion of the lever protruding piece 67*b* and a slide bush 47 is slidably supported in the elongated hole 67*c*. When the fully opening lock releasing lever 67 is at the original position as illustrated in FIGS. 5 and 6, the slide bush 47 is disposed at a terminal end of the elongated hole 67*c* in the first rotation direction.

The fully opening lock releasing lever 67 is linked to the vehicle internal operation handle 4 at the slide bush 47. When a closing operation is performed on the vehicle internal operation handle 4, the fully opening lock releasing lever 67 is pressed by the vehicle internal operation handle 4 and is rotated in the first rotation direction around the support shaft 71. At this time, the release cable C3 connected to the lever protruding piece 67*a* is pulled toward the remote controller 5 side and the fully opening door lock device 8 is released. The fully opening lock releasing lever 67 is urged in the second rotation direction by a pulling coil spring 72 (refer to FIG. 5) that connects the base plate 61 and the lever protruding piece 67*a* to each other.

The vehicle internal handle connection lever 64 projects in a radial direction centered on the support shaft 71 that is approximately parallel to the lever protruding piece 67*a* and a distal end thereof is linked to the vehicle internal operation handle 4. In addition, in a state where the vehicle internal operation handle 4 is not operated, the vehicle internal handle connection lever 64 is held at the original position as illustrated in FIGS. 5 and 6. In addition, when an opening operation is performed on the vehicle internal operation handle 4 to apply a releasing operation force, the vehicle internal handle connection lever 64 is pulled by the vehicle internal operation handle 4 and the vehicle internal handle connection lever 64 is rotated in the first rotation direction around the support shaft 71 from the original position.

The relay lever 62 is urged in the second rotation direction by a torsion coil spring 73 that is wound around the support shaft 71. The relay lever 62 is provided with a pair of lever protruding pieces 62*a* and 62*b*, the lever protruding pieces 62*a* and 62*b* projecting in different radial directions (downward direction and rightward and upward direction in drawing) centered on the support shaft 71. One lever protruding piece 62*a* is disposed to overlap the fully closing lock releasing lever 63.

From a side edge portion of the lever protruding piece 62*a* that faces the second rotation direction, an interlock abutting piece 62*f* is bent and raised up toward the vehicle external handle connection lever 66 side (front side in drawing) at the right angle. In addition, from a side edge portion of the lever protruding piece 62*a* that faces the first rotation direction, an interlock abutting piece 62*h* is bent and raised up toward the fully closing lock releasing lever 63 side (front side in drawing) at the right angle.

The other lever protruding piece 62*b* is disposed forward of the vehicle internal handle connection lever 64 in the first rotation direction. In addition, a connection pin 76 is inserted into the lever protruding piece 62*b* and is supported in the lever protruding piece 62*b*. When the vehicle internal handle connection lever 64 rotates in the first rotation direction, the relay lever 62 can be integrally rotated in the first rotation direction via the connection pin 76.

The fully closing lock releasing lever 63 is provided with a pair of lever protruding pieces 63*a* and 63*b*, the lever protruding pieces 63*a* and 63*b* projecting in opposite radial directions centered on the support shaft 71. An approximately linear elongated hole 63*c* as an elongated hole that extends in a direction approximately orthogonal to one radial direction centered on the support shaft 71 and an approximately linear elongated hole 63*d* as an elongated hole that extends to be approximately parallel to the elongated hole 63*c* at a position close to an outer circumference of the elongated hole 63*c* are formed to penetrate a distal end portion of one lever protruding piece 63*a* that protrudes toward the same side as the vehicle internal handle connection lever 64. The elongated hole 63*c* on an inner circumferential side is set to be smaller than the elongated hole 63*d* on an outer circumferential side in longitudinal opening dimension.

Figure 7A:
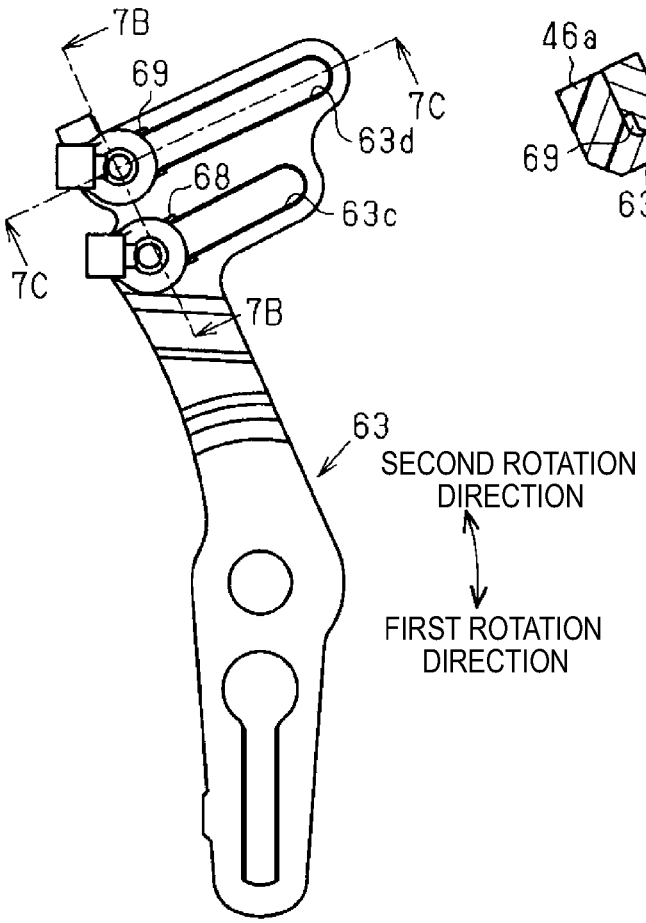
FIG. 7A is a side view illustrating a structure of a fully closing lock releasing lever of the vehicle door opening/closing device according to the first embodiment.
Figure 7B:
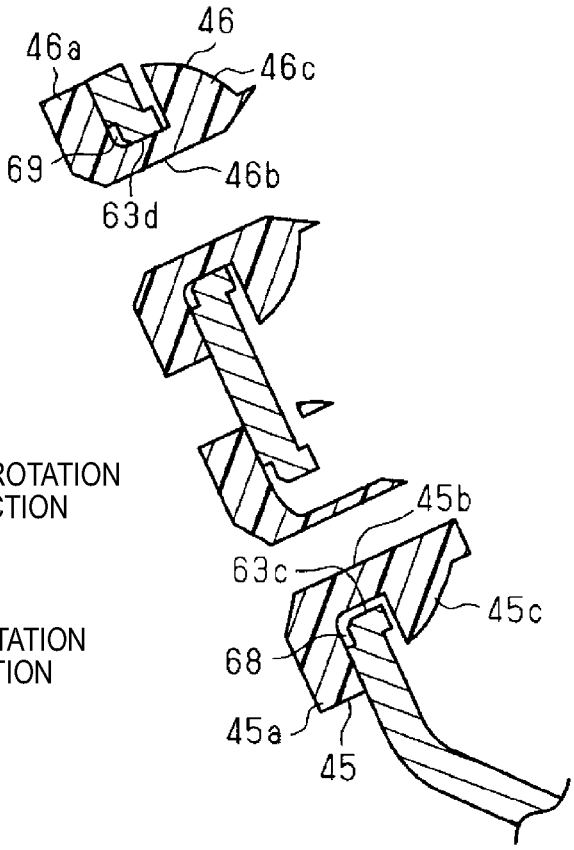
FIG. 7B is a sectional view taken along line 7B-7B in FIG. 7A.
Figure 7C:
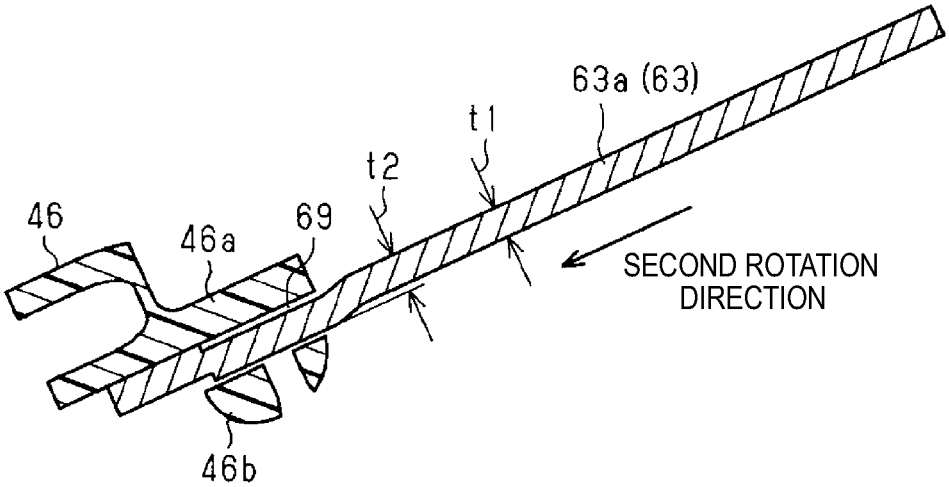
FIG. 7C is a sectional view taken along line 7C-7C in FIG. 7A.

In addition, as illustrated in FIGS. 7A to 7C, a terminal end of a circumferential edge portion of the elongated hole 63*d* that is on a forward side in the second rotation direction is formed with a thick portion 69 that is formed through, for example, half blanking molding. By means of the half blanking molding, the thick portion 69 is displaced in a thickness direction of the fully closing lock releasing lever 63 such that a practical thickness t2 is set to be larger than an original thickness t1 of a circumferential edge portion of the elongated hole 63*d* other than the thick portion 69. Similarly, a terminal end of a circumferential edge portion of the elongated hole 63*c* that is on a forward side in the second rotation direction is formed with a thick portion 68 that is equivalent to the thick portion 69.

As illustrated in FIGS. 5 and 6, a terminal of the release cable C1 is latched in the elongated hole 63*c* of the fully closing lock releasing lever 63. That is, a terminal 41*b* of the above-described guide tube 41 of the release cable C1 is fitted into the cable locking portion 61*a* and a sliding portion 45, into which a distal end of the above-described internal cable 42 exposed from the terminal 41*b* is inserted, is inserted to be able to slide along the elongated hole 63*c*. As illustrated in FIGS. 7A to 7C, the sliding portion 45 is provided with an approximately annular fixation portion 45*a*, is provided with an approximately cylindrical connection portion 45*b* that protrudes to be approximately concentric with the fixation portion 45*a* and is inserted into the elongated hole 63*c*, and is provided with an approximately flange-shaped come-off prevention portion 45*c* that protrudes from a distal end of the connection portion 45*b* that penetrates the elongated hole 63*c*. The connection portion 45*b* of the sliding portion 45 is inserted to be able to slide along the elongated hole 63*c* in a state where the circumferential edge portion of the elongated hole 63*c* is clamped by the fixation portion 45*a* and the come-off prevention portion 45*c* for come-off prevention. A force by which the fixation portion 45*a* and the come-off prevention portion 45*c* clamp the circumferential edge portion of the elongated hole 63*c* is increased as much as the thick portion 68 is thickened. That is, the sliding of the sliding portion 45 is relatively suppressed at the thick portion 68.

In addition, as illustrated in FIGS. 5 and 6, a terminal of the release cable C2 is latched in the elongated hole 63*d* of the fully closing lock releasing lever 63. That is, a terminal 43*b* of the above-described guide tube 43 of the release cable C2 is fitted into the cable locking portion 61*b* and a sliding portion 46, into which a distal end of the above-described internal cable 44 exposed from the terminal 43*b* is inserted, is inserted to be able to slide along the elongated hole 63*d*. As illustrated in FIGS. 7A to 7C, the sliding portion 46 is also provided with a fixation portion 46*a*, a connection portion 46*b*, and a come-off prevention portion 46*c* as with the sliding portion 45. The connection portion 46*b* of the sliding portion 46 is inserted to be able to slide along the elongated hole 63*d* in a state where the circumferential edge portion of the elongated hole 63*d* is clamped by the fixation portion 46*a* and the come-off prevention portion 46*c* for come-off prevention. It is a matter of course that the sliding of the sliding portion 46 is relatively suppressed at the thick portion 69.

When the fully closing lock releasing lever 63 is at the original position as illustrated in FIGS. 5 and 6, the sliding portions 45 and 46 are normally disposed at the thick portions 68 and 69, respectively. In addition, when the fully closing lock releasing lever 63 rotates in the first rotation direction around the support shaft 71 from the original position, the internal cables 42 and 44 of the release cables C1 and C2 are pulled toward the remote controller 5 side along with the sliding portions 45 and 46 which are respectively disposed at the thick portions 68 and 69.

A common connection pin 75 is inserted into the lever protruding piece 62*a* of the relay lever 62 and the other lever protruding piece 63*b* of the fully closing lock releasing lever 63 that overlaps the lever protruding piece 62*a* and the connection pin 75 is supported therein. Here, a side edge portion of the lever protruding piece 63*b* of the fully closing lock releasing lever 63 that faces the first rotation direction can abut onto the interlock abutting piece 62*h* of the relay lever 62. Accordingly, the fully closing lock releasing lever 63 receives an urging force of the torsion coil spring 73 via the relay lever 62 and is urged in the second rotation direction. In addition, normally, both of the fully closing lock releasing lever 63 and the relay lever 62 are positioned at the original positions illustrated in FIGS. 5 and 6 with a stopper portion 63*e* abutting onto the base plate 61, the stopper portion 63*e* being provided on the distal end portion of the lever protruding piece 63*a*. In addition, when the relay lever 62 rotates, the fully closing lock releasing lever 63 can be integrally rotated via the connection pin 75.

The vehicle external handle connection lever 66 projects in a radial direction centered on the support shaft 71 that is approximately parallel to the relay lever 62 (lever protruding piece 62*a*) and the power connection lever 65 and a distal end portion thereof is connected to the vehicle external operation handle 3 via a cable C5.

In addition, from a side edge portion of the vehicle external handle connection lever 66 that faces the second rotation direction, an interlock abutting piece 66*c* is bent and raised up toward the relay lever 62 side (back side in drawing) at the right angle. The interlock abutting piece 66*c* is disposed to face the interlock abutting piece 62*f* of the vehicle external handle connection lever 66 in the first rotation direction.

Furthermore, from a side edge portion of the vehicle external handle connection lever 66 that faces the first rotation direction, an interlock abutting piece 66*d* is bent and raised up toward the fully opening lock releasing lever 67 side (front side in drawing) at the right angle. The interlock abutting piece 66*d* is disposed to face the interlock abutting piece 67*d* of the vehicle external handle connection lever 66 in the first rotation direction.

Here, the interlock abutting piece 66*d* of the vehicle external handle connection lever 66 can abut onto the interlock abutting piece 67*d* of the fully opening lock releasing lever 67. Accordingly, the vehicle external handle connection lever 66 receives an urging force of the pulling coil spring 72 via the fully opening lock releasing lever 67 and is urged in the second rotation direction. In addition, normally, the vehicle external handle connection lever 66 is positioned at the original position illustrated in FIGS. 5 and 6 with a stopper portion 66*f* abutting onto the base plate 61, the stopper portion 66*f* being provided on a distal end portion of the vehicle external handle connection lever 66. In addition, the fully opening lock releasing lever 67 is positioned at the original position as illustrated in FIGS. 5 and 6 via the vehicle external handle connection lever 66 abutting onto the base plate 61.

In addition, when the vehicle external operation handle 3 is operated, the rear lock 6 is pulled by the cable C5 and the vehicle external handle connection lever 66 is rotated in the first rotation direction around the support shaft 71 from the original position. At this time, the relay lever 62 whose interlock abutting piece 62*f* is pressed by the interlock abutting piece 66*c* and the fully opening lock releasing lever 67 whose interlock abutting piece 67*d* is pressed by the interlock abutting piece 66*d* are integrally rotated in the first rotation direction around the support shaft 71.

Accordingly, when the vehicle external operation handle 3 is operated to apply a releasing operation force, the vehicle external handle connection lever 66, the relay lever 62, and the fully closing lock releasing lever 63 (via connection pin 75) are integrally rotated in the first rotation direction around the support shaft 71 from the original positions.

The power connection lever 65 is provided with a lever protruding piece 65*a* that projects in a radial direction centered on the support shaft 71 that is approximately parallel to the relay lever 62 (lever protruding piece 62*a*) and the vehicle external handle connection lever 66. In addition, an approximately arc-shaped elongated hole 65*b* that extends in a circumferential direction centered on the support shaft 71 is formed to penetrate a distal end portion of the lever protruding piece 65*a* and a slide bush 48 is slidably supported in the elongated hole 65*b*. The slide bush 48 is connected to the release actuator 9 via the cable C4. The release actuator 9 has an electric motor that is operated by means of a remote operation (operation on remote controller key or door opening/closing button) as a main part.

In addition, from a side edge portion of the lever protruding piece 65*a* that faces the first rotation direction, an interlock abutting piece 65*c* protrudes. The interlock abutting piece 65*c* is disposed to face the connection pin 75 of the power connection lever 65 in the first rotation direction.

Furthermore, the power connection lever 65 is provided with a lever protruding piece 65*e* that projects in a radial direction centered on the support shaft 71 that is approximately parallel to the fully opening lock releasing lever 67 (lever protruding piece 67*a*). From a side edge portion of the lever protruding piece 65*e* that faces the second rotation direction, an interlock abutting piece 65*f* is bent and raised up toward the fully opening lock releasing lever 67 side (front side in drawing) at the right angle. The interlock abutting piece 65*f* is disposed to face a side edge portion of the fully opening lock releasing lever 67 (lever protruding piece 67*a*) in the first rotation direction of the power connection lever 65.

Here, the interlock abutting piece 65*f* of the power connection lever 65 can abut onto the side edge portion of the fully opening lock releasing lever 67. Accordingly, the power connection lever 65 receives an urging force of the pulling coil spring 72 via the fully opening lock releasing lever 67 and is urged in the second rotation direction. In addition, normally, the power connection lever 65 is positioned at the original position illustrated in FIGS. 5 and 6 with a stopper portion 65*d* abutting onto the base plate 61, the stopper portion 65*d* being provided on a distal end portion of the lever protruding piece 65*a*. In addition, the fully opening lock releasing lever 67 that urges the power connection lever 65 in the second rotation direction is positioned at the original position as illustrated in FIGS. 5 and 6 via the power connection lever 65 abutting onto the base plate 61.

Accordingly, when the release actuator 9 is driven to generate a releasing operation force and the cable C4 is pulled to the release actuator 9 side due to the releasing operation force (driving force), the power connection lever 65 is rotated in the first rotation direction around the support shaft 71 from the original position in a state of being separated from the vehicle internal handle connection lever 64 and the vehicle external handle connection lever 66. At this time, the interlock abutting piece 65*c* presses the connection pin 75 and the fully closing lock releasing lever 63 (and relay lever 62) is integrally rotated in the first rotation direction around the support shaft 71 from the original position via the connection pin 75.

At the same time, the interlock abutting piece 65*f* of the power connection lever 65 presses the fully opening lock releasing lever 67 and the fully opening lock releasing lever 67 is integrally rotated in the first rotation direction around the support shaft 71 from the original position.

When the releasing operation force of the vehicle external operation handle 3 or the like is released, the fully closing lock releasing lever 63 receives the urging force of the torsion coil spring 73 via the relay lever 62 and is rotated in the second rotation direction around the support shaft 71 up to the original position.

The operation of the present embodiment will be described.

First, when an opening operation is performed on the vehicle internal operation handle 4 to apply a releasing operation force with the slide door 2 being in the fully-closed state, the vehicle internal handle connection lever 64 pulled by the vehicle internal operation handle 4 is rotated in the first rotation direction around the support shaft 71 to press the connection pin 76 and the relay lever 62 is integrally rotated in the first rotation direction. The rotation of the relay lever 62 is transmitted to the fully closing lock releasing lever 63 via the connection pin 75 and the fully closing lock releasing lever 63 is integrally rotated with the relay lever 62 in the first rotation direction around the support shaft 71 from the original position. Accordingly, the internal cables 42 and 44 of the release cables C1 and C2 are pulled toward the remote controller 5 side along with the sliding portions 45 and 46 which are respectively disposed at the thick portions 68 and 69 and the open levers 32 and 54 are rotated around the support pins 31 and 53 toward the releasing operation positions from the initial positions. At this time, the slide door 2 that is held in the fully-closed state or the half-closed state (closed state) by the latch mechanism 22 of the rear lock 6 is released and the slide door 2 that is held in the fully-closed state (closed state) by the latch mechanism 52 of the front lock 7 is released as described above such that the slide door 2 enters the openable state.

Meanwhile, when a closing operation is performed on the vehicle internal operation handle 4 with the slide door 2 being in the fully-opened state, the fully opening lock releasing lever 67 pressed by the vehicle internal operation handle 4 is rotated in the first rotation direction around the support shaft 71. Accordingly, the release cable C3 is pulled toward the remote controller 5 side and the fully opening door lock device 8 is released. In addition, the slide door 2 enters the closable state.

In addition, when the vehicle external operation handle 3 is operated to apply a releasing operation force with the slide door 2 being in the fully-closed state or the fully-opened state, the vehicle external handle connection lever 66 pulled by the vehicle external operation handle 3 via the cable C5 is rotated in the first rotation direction around the support shaft 71. At this time, the interlock abutting piece 66*c* presses the interlock abutting piece 62*f* of the relay lever 62 and the relay lever 62 is integrally rotated in the first rotation direction. The rotation of the relay lever 62 is transmitted to the fully closing lock releasing lever 63 via the connection pin 75 and the fully closing lock releasing lever 63 is integrally rotated with the relay lever 62 in the first rotation direction around the support shaft 71 from the original position. Accordingly, if the slide door 2 is in the fully-closed state, the slide door 2 that is held in the fully-closed state or the half-closed state (closed state) by the latch mechanism 22 of the rear lock 6 is released and the slide door 2 that is held in the fully-closed state (closed state) by the latch mechanism 52 of the front lock 7 is released as described above such that the slide door 2 enters the openable state.

At the same time, the interlock abutting piece 66*d* presses the interlock abutting piece 67*d* of the fully opening lock releasing lever 67 and the fully opening lock releasing lever 67 is integrally rotated in the first rotation direction around the support shaft 71 from the original position. Accordingly, if the slide door 2 is in the fully-opened state, the fully opening door lock device 8 is released as described above and the slide door 2 enters the closable state.

Next, the description will be made on an assumption that the release actuator 9 has been driven to generate a releasing operation force by means of a remote operation (operation on remote controller key or door opening/closing button in vehicle) without operating any of the vehicle external operation handle 3 and the vehicle internal operation handle 4 with the slide door 2 being in the fully-closed state or the fully-opened state. In this case, the cable C4 is pulled toward the release actuator 9 side and the power connection lever 65 is rotated in the first rotation direction. At this time, the interlock abutting piece 65*c* presses the connection pin 75 and the fully closing lock releasing lever 63 (and relay lever 62) is integrally rotated in the first rotation direction around the support shaft 71 from the original position via the connection pin 75. Accordingly, if the slide door 2 is in the fully-closed state, the slide door 2 that is held in the fully-closed state or the half-closed state (closed state) by the latch mechanism 22 of the rear lock 6 is released and the slide door 2 that is held in the fully-closed state (closed state) by the latch mechanism 52 of the front lock 7 is released as described above such that the slide door 2 enters the openable state.

At the same time, the interlock abutting piece 65*f* presses the fully opening lock releasing lever 67 and the fully opening lock releasing lever 67 is integrally rotated in the first rotation direction around the support shaft 71 from the original position. Accordingly, if the slide door 2 is in the fully-opened state, the fully opening door lock device 8 is released as described above and the slide door 2 enters the closable state.

Figure 8:
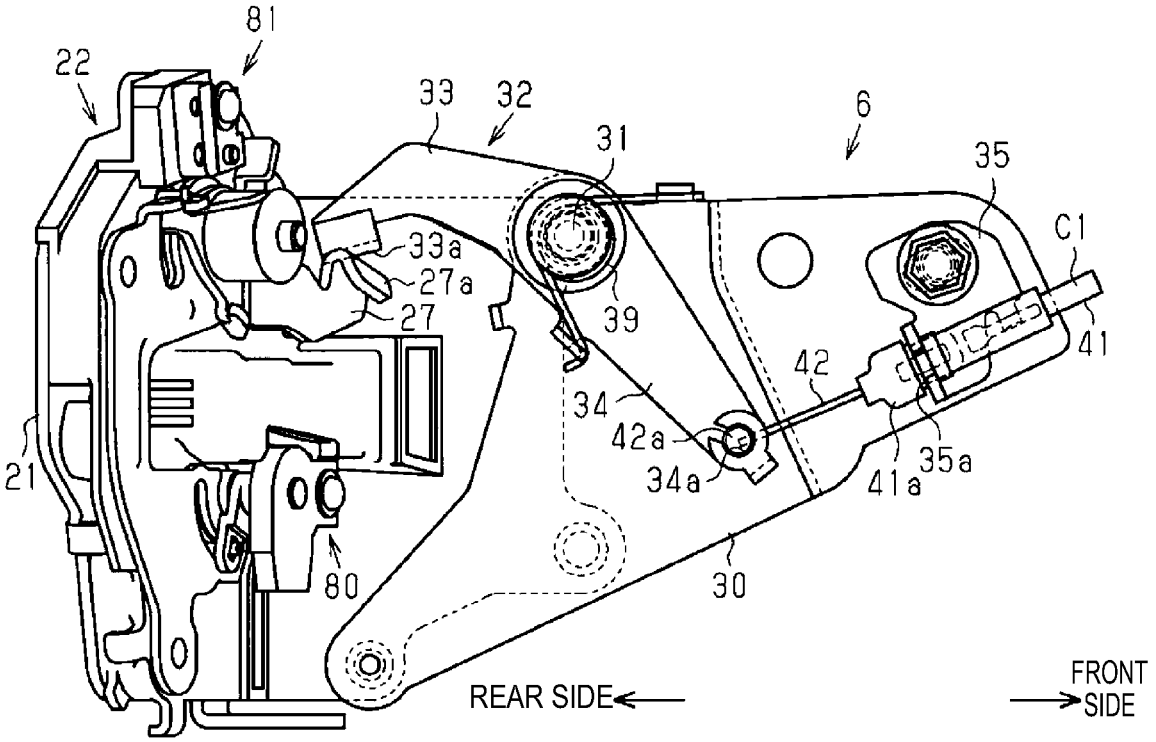
FIG. 8 is a side view illustrating an operation of the rear lock of the vehicle door opening/closing device according to the first embodiment.

Here, the description will be made on an assumption that the open lever 32 of the rear lock 6 is bound at the releasing operation position due to rust or the like with the slide door 2 being in the closed state as illustrated in FIG. 8. At this time, the latch mechanism 22 of the rear lock 6 is held in the unlatched state and the slide door 2 cannot be held in the fully-closed state or the half-closed state (closed state). In addition, the open lever 32 stuck at the releasing operation position continuously presses the internal cable 42 toward the remote controller 5 side.

Figure 10:
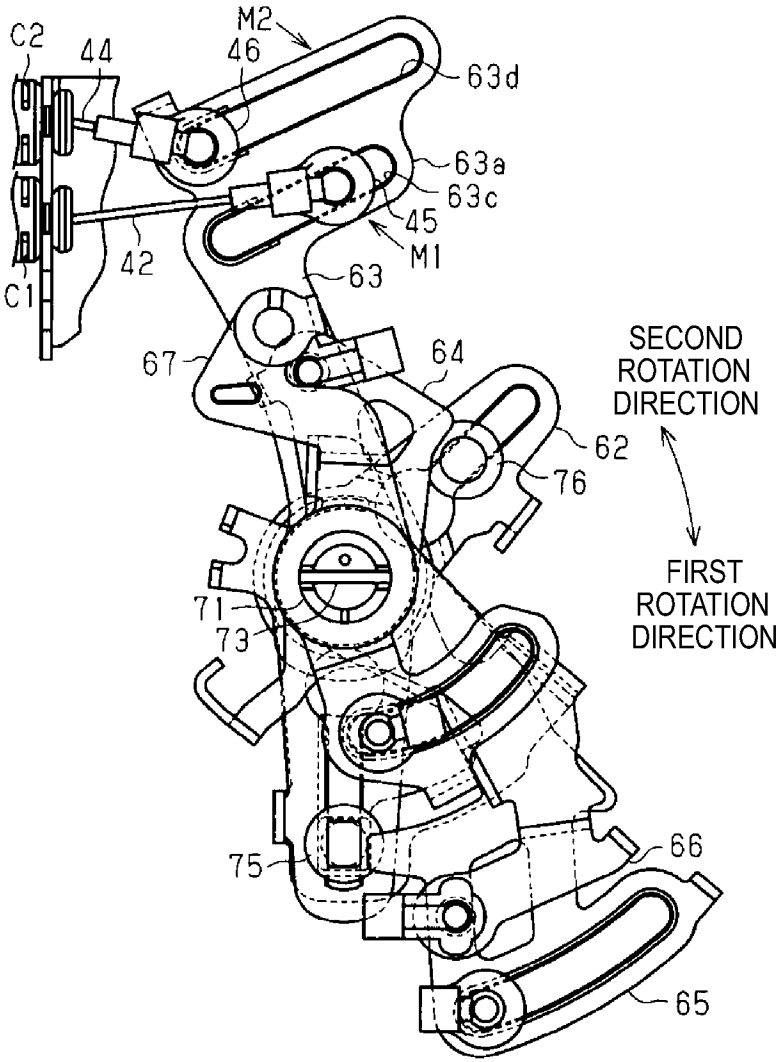
FIG. 10 is a side view illustrating an operation of a lost motion mechanism of the vehicle door opening/closing device according to the first embodiment.

At this time, as illustrated in FIG. 10, the fully closing lock releasing lever 63 that receives the urging force of the torsion coil spring 73 via the relay lever 62 rotates (returns) in the second rotation direction around the support shaft 71 up to the original position while the sliding portion 45 of the internal cable 42 pressed toward the remote controller 5 side slides within an area of the elongated hole 63*c*. That is, even when the internal cable 42 is pressed toward the remote controller 5 side by the open lever 32, since the elongated hole 63*c* extends in a direction in which the internal cable 42 is pressed, power that inhibits the fully closing lock releasing lever 63 from returning to the original position is not transmitted to the fully closing lock releasing lever 63.

When the fully closing lock releasing lever 63 returns to the original position, the open lever 54 of the front lock 7 returns to the initial position while being urged by the return spring 59. Accordingly, the latch mechanism 52 of the front lock 7 becomes able to hold the slide door 2 in the fully-closed state (closed state). The elongated hole 63*c* and the sliding portion 45 constitute a lost motion mechanism M1 that allows the open lever 54 of the front lock 7 to return to the initial position when the open lever 32 of the rear lock 6 is bound at the releasing operation position. It is a matter of course that the lost motion mechanism M1 is disposed on the fully closing lock releasing lever 63 side (remote controller 5 side) of the release cable C1.

Figure 9:
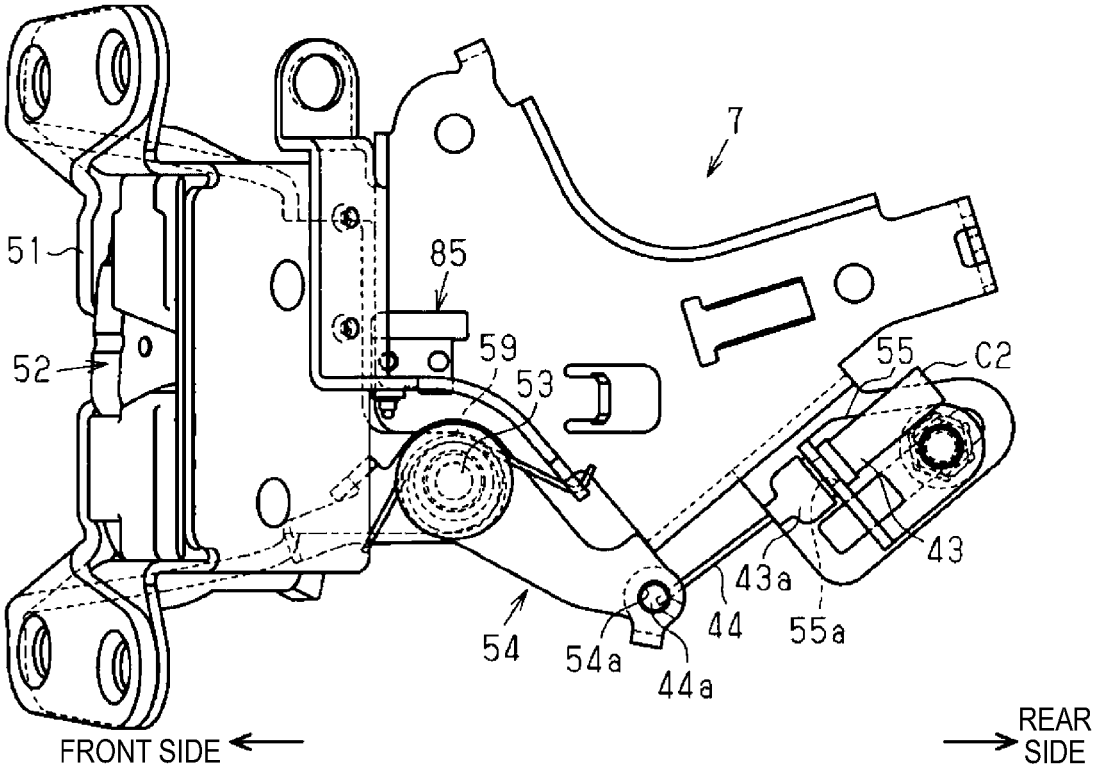
FIG. 9 is a side view illustrating an operation of the front lock of the vehicle door opening/closing device according to the first embodiment.

Meanwhile, the description will be made on an assumption that the open lever 54 of the front lock 7 is bound at the releasing operation position due to rust or the like with the slide door 2 being in the closed state as illustrated in FIG. 9. At this time, the latch mechanism 52 of the front lock 7 is held in the unlatched state and the slide door 2 cannot be held in the fully-closed state. In addition, the open lever 54 stuck at the releasing operation position continuously presses the internal cable 44 toward the remote controller 5 side.

Figure 11:
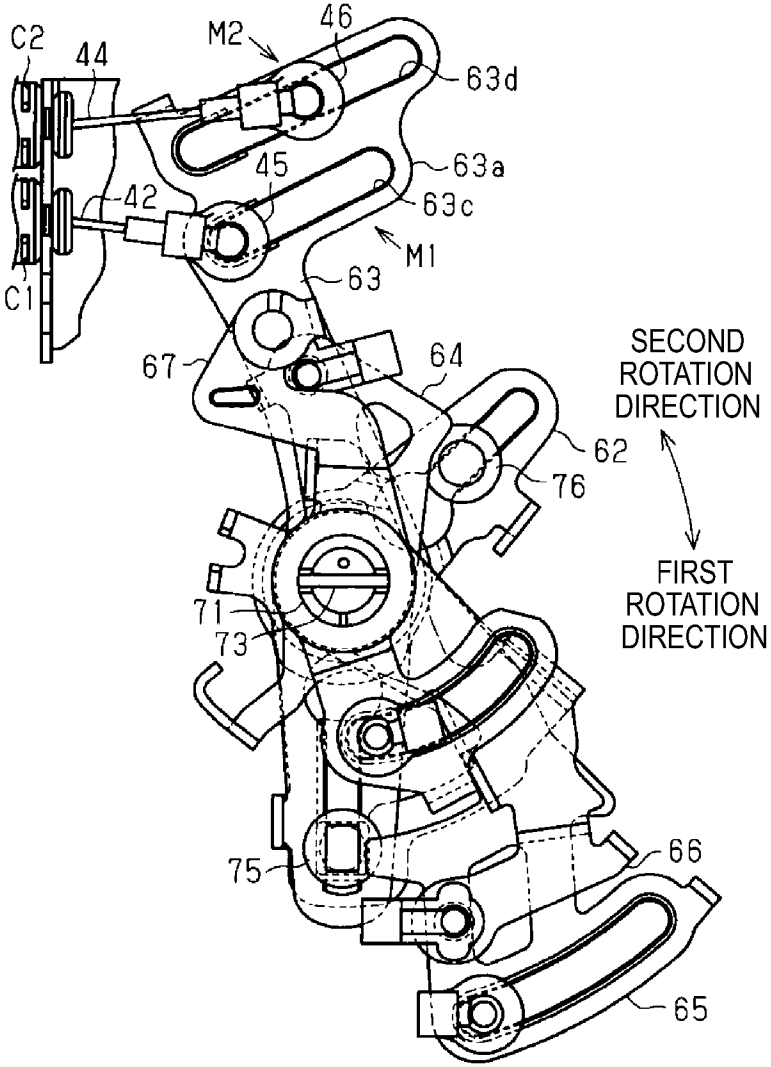
FIG. 11 is a side view illustrating an operation of the lost motion mechanism of the vehicle door opening/closing device according to the first embodiment.

At this time, as illustrated in FIG. 11, the fully closing lock releasing lever 63 that receives the urging force of the torsion coil spring 73 via the relay lever 62 rotates (returns) in the second rotation direction around the support shaft 71 up to the original position while the sliding portion 46 of the internal cable 44 pressed toward the remote controller 5 side slides within an area of the elongated hole 63*d*. That is, even when the internal cable 44 is pressed toward the remote controller 5 side by the open lever 54, since the elongated hole 63*d* extends in a direction in which the internal cable 44 is pressed, power that inhibits the fully closing lock releasing lever 63 from returning to the original position is not transmitted to the fully closing lock releasing lever 63.

When the fully closing lock releasing lever 63 returns to the original position, the open lever 32 of the rear lock 6 returns to the initial position while being urged by the return spring 39. Accordingly, the latch mechanism 22 of the rear lock 6 becomes able to hold the slide door 2 in the fully-closed state or the half-closed state (closed state). The elongated hole 63*d* and the sliding portion 46 constitute a lost motion mechanism M2 that allows the open lever 32 of the rear lock 6 to return to the initial position when the open lever 54 of the front lock 7 is bound at the releasing operation position. It is a matter of course that the lost motion mechanism M2 is disposed on the fully closing lock releasing lever 63 side (remote controller 5 side) of the release cable C2.

Next, an electrical configuration in the present embodiment will be described.

As illustrated in FIG. 12, the rear lock 6 is provided with a latch switch 80, which is a rotary switch, for example. The latch switch 80 is for detecting the rotation position (unlatching position or like) of the latch 25. That is, the latch switch 80 enters an OFF state when the latch 25 is at the full latch position and enters an ON state when the latch 25 is separated from the full latch position.

In addition, the rear lock 6 is provided with a pawl switch 81, which is a single-pole single-throw momentary switch, for example. The pawl switch 81 is for detecting the swinging of the pawl 26 from the initial rotation position. That is, the pawl switch 81 enters an OFF state by being pressed by the pawl driving lever 27 integrated with the pawl 26 when the pawl 26 is at the initial rotation position and the pawl switch 81 enters an ON state by being released from the pawl driving lever 27 when the pawl 26 is separated from the initial rotation position.

Therefore, in a state where the slide door 2 is held in the fully-closed state (closed state) by the latch mechanism 22 of the rear lock 6, both of the latch switch 80 and the pawl switch 81 enter the OFF state. Otherwise, at least one of the latch switch 80 and the pawl switch 81 enters the ON state. The latch switch 80 and the pawl switch 81 constitute a first switch that detects (determines) whether the slide door 2 is held in the fully-closed state (closed state) by the latch mechanism 22 by means of co-operation.

Meanwhile, as illustrated in FIGS. 4 and 9, the front lock 7 is provided with a front lever switch 85 as a second switch, which is a single-pole single-throw momentary switch, for example. The front lever switch 85 is for detecting the swinging of the open lever 54 from the initial position. That is, the front lever switch 85 enters an OFF state by being pressed by the open lever 54 when the open lever 54 is at the initial position and the front lever switch 85 enters an ON state by being released when the open lever 54 is separated from the initial position. The front lever switch 85 detects (determines) whether the open lever 54 is at the initial position.

As illustrated in FIG. 13, the latch switch 80, the pawl switch 81, and the front lever switch 85 are electrically connected to an electronic control device 90 as a determination unit that is configured by using a microcomputer as a main part. A notification unit 91, which is a light emitting device or a vocal device, is electrically connected to the electronic control device 90, for example. The electronic control device 90 determines whether the front lock 7 is in an abnormal state based on the result of detection performed by the latch switch 80, the pawl switch 81, and the front lever switch 85. In addition, when the electronic control device 90 determines that the front lock 7 is in an abnormal state, the electronic control device 90 drives the notification unit 91 to notify that the front lock 7 is in the abnormal state.

Specifically, as illustrated in FIG. 14, the electronic control device 90 determines that the front lock 7 is in a normal state if the front lever switch 85 is in the OFF state with both of the latch switch 80 and the pawl switch 81 being in the OFF state and determines that the front lock 7 is in the abnormal state if the front lever switch 85 is in the ON state with both of the latch switch 80 and the pawl switch 81 being in the OFF state. That is, the electronic control device 90 determines that the front lock 7 is in the abnormal state when it is detected that the slide door 2 is held in the fully-closed state (closed state) by the latch mechanism 22 of the rear lock 6 and it is detected that the open lever 54 is not at the initial position (while being bound at releasing operation position due to rust or like, for example).

The effect of the present embodiment will be described.

(1) In the present embodiment, even in a state where any one of the open levers 32 and 54 of the rear lock 6 and the front lock 7 is bound at the releasing operation position with the slide door 2 being in the fully-closed state (closed state), the other of the open levers 32 and 54 is allowed to return to the initial position since the lost motion mechanisms M1 and M2 are provided. Therefore, even if any one of the latch mechanisms 22 and 52 of the rear lock 6 and the front lock 7 becomes not able to hold the slide door 2 in the fully-closed state (closed state), the other of the latch mechanisms 22 and 52 of the rear lock 6 and the front lock 7 can hold the slide door 2 in the fully-closed state (closed state).

(2) In the present embodiment, in a case where any one of the open levers 32 and 54 of the rear lock 6 and the front lock 7 is bound at the releasing operation position, the fully closing lock releasing lever 63 is not restricted by the open levers 32 and 54 and can perform returning rotation since the sliding portions 45 and 46 of the release cables C1 and C2 connected to the open levers 32 and 54 slide within areas of the elongated holes 63*c* and 63*d*. Accordingly, the other of the open levers 32 and 54 of the rear lock 6 and the front lock 7 is allowed to return to the initial position. As described above, it is possible to extremely simplify the configuration of the lost motion mechanisms M1 and M2 by using the elongated holes 63*c* and 63*d* and sliding portions 45 and 46.

(3) In the present embodiment, a force by which the sliding portions 45 and 46 clamp the circumferential edge portions of the elongated holes 63*c* and 63*d* is increased as much as the thick portions 68 and 69 are thickened. That is, the sliding of the sliding portions 45 and 46 is relatively suppressed at the thick portions 68 and 69. Therefore, it is possible to restrain the open levers 32 and 54 from deviating from the initial positions thereof with the sliding portions 45 and 46 of the release cables C1 and C2 sliding within the elongated holes 63*c* and 63*d*.

In addition, since the practical thicknesses of the thick portions 68 and 69 are set to be large through half blanking molding, it is possible to decrease the number of manufacturing processes in comparison with a case where the thickness is increased by using a resin mold through insert molding or the like and it is possible to achieve a decrease in cost.

(4) In the present embodiment, the open levers 32 and 54 of the rear lock 6 and the front lock 7 are urged to rotate toward the initial positions by the return springs 39 and 59, respectively. Therefore, it is possible to further restrain the open levers 32 and 54 from deviating from the initial positions thereof with the sliding portions 45 and 46 of the release cables C1 and C2 sliding within the elongated holes 63*c* and 63*d*.

(5) In the present embodiment, in a case where the latch switch 80 and the pawl switch 81 (first switch) detect that the slide door 2 is held in the fully-closed state (closed state) by the latch mechanism 22 of the rear lock 6 and the front lever switch 85 detects that the open lever 54 of the front lock 7 is not at the initial position, the electronic control device 90 determines that the front lock 7 is in an abnormal state and the notification unit 91 performs notification. Accordingly, it is possible to reduce a possibility that a state where the slide door 2 is held in the fully-closed state (closed state) by only the latch mechanism 22 of the rear lock 6 meaninglessly continues.

Second Embodiment

Hereinafter, a second embodiment of the vehicle door opening/closing device will be described. The second embodiment is obtained by changing the first embodiment such that one of the lost motion mechanisms in the first embodiment is disposed on the open lever side (door lock device side) of the release cable. Therefore, detailed description on the same parts as those in the first embodiment will be omitted. Regarding a component in the second embodiment that has the same function as that in the first embodiment, values of the ten's digit and the one's digit of a reference numeral are the same as those in the first embodiment.

Figure 15:
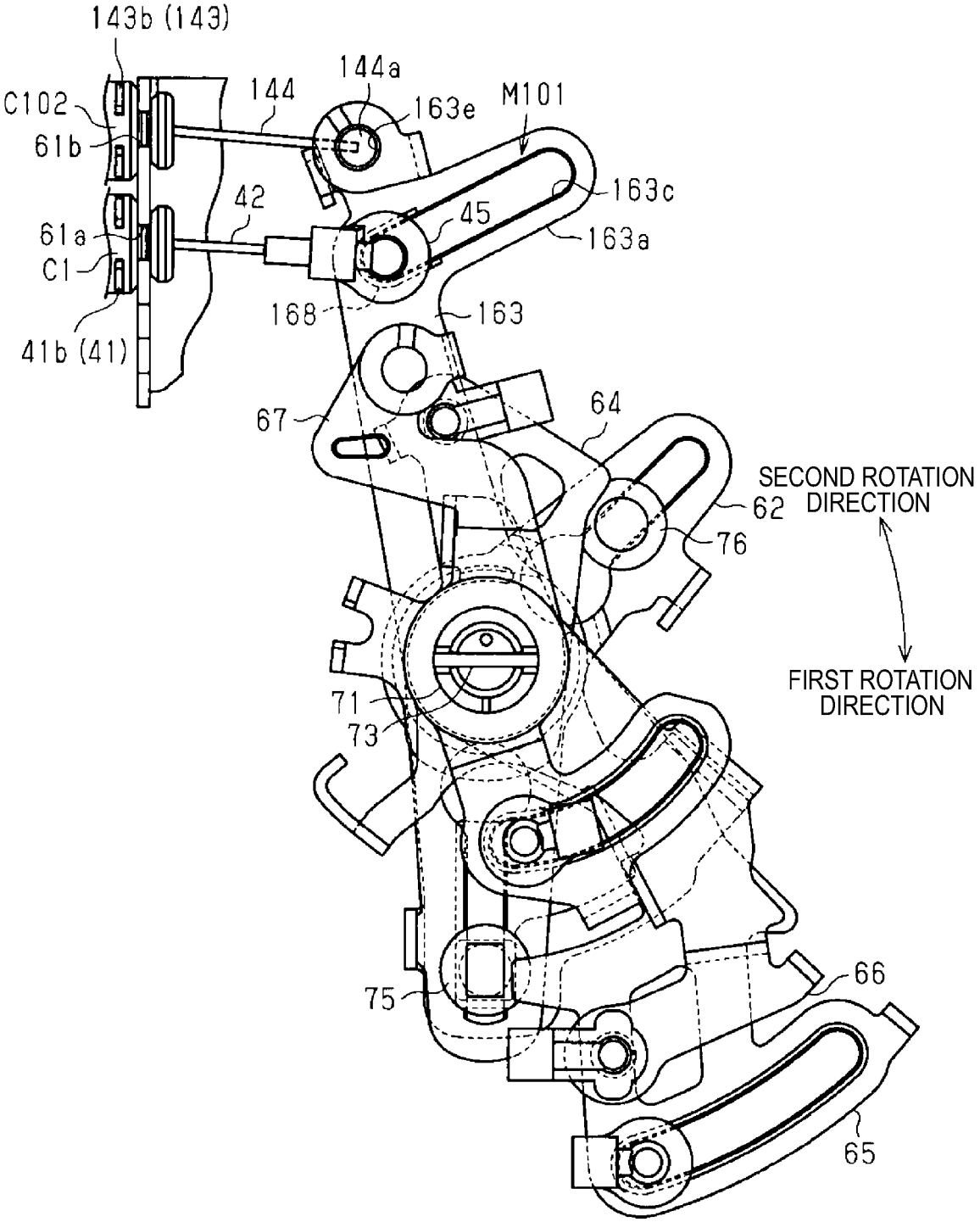
FIG. 15 is a side view illustrating a structure of a remote controller of a vehicle door opening/closing device according to a second embodiment.

As illustrated in FIG. 15, an elongated hole 163*c* as an elongated hole that is equivalent to the elongated hole 63*c* is formed to penetrate a distal end portion of a lever protruding piece 163*a* of a fully closing lock releasing lever 163 of the present embodiment and an approximately circular latching hole 163*e* that penetrates the distal end portion in a thickness direction at a position close to an outer circumference of the elongated hole 163*c* is formed to penetrate the distal end portion.

A terminal of the release cable C1 is latched in the elongated hole 163*c* of the fully closing lock releasing lever 163. That is, the sliding portion 45 of the internal cable 42 of the release cable C1 is inserted to be able to slide along the elongated hole 163*c*. A circumferential edge portion of the elongated hole 163*c* that is pulled by the sliding portion 45 when the fully closing lock releasing lever 163 rotates is formed with a thick portion 168 equivalent to the thick portion 68.

In addition, a terminal of a release cable C102 equivalent to the release cable C2 is latched in the latching hole 163*e* of the fully closing lock releasing lever 163. That is, the release cable C102 is provided with a guide tube 143 that is routed between the front lock 7 and the release cable C102 and an internal cable 144 that is inserted into the guide tube 143. In addition, a terminal 143*b* of the guide tube 143 is fitted into the cable locking portion 61*b* and an approximately columnar terminal 144*a* of the internal cable 144 exposed from the terminal 143*b* is inserted into and latched in the latching hole 163*e*.

Figure 16:
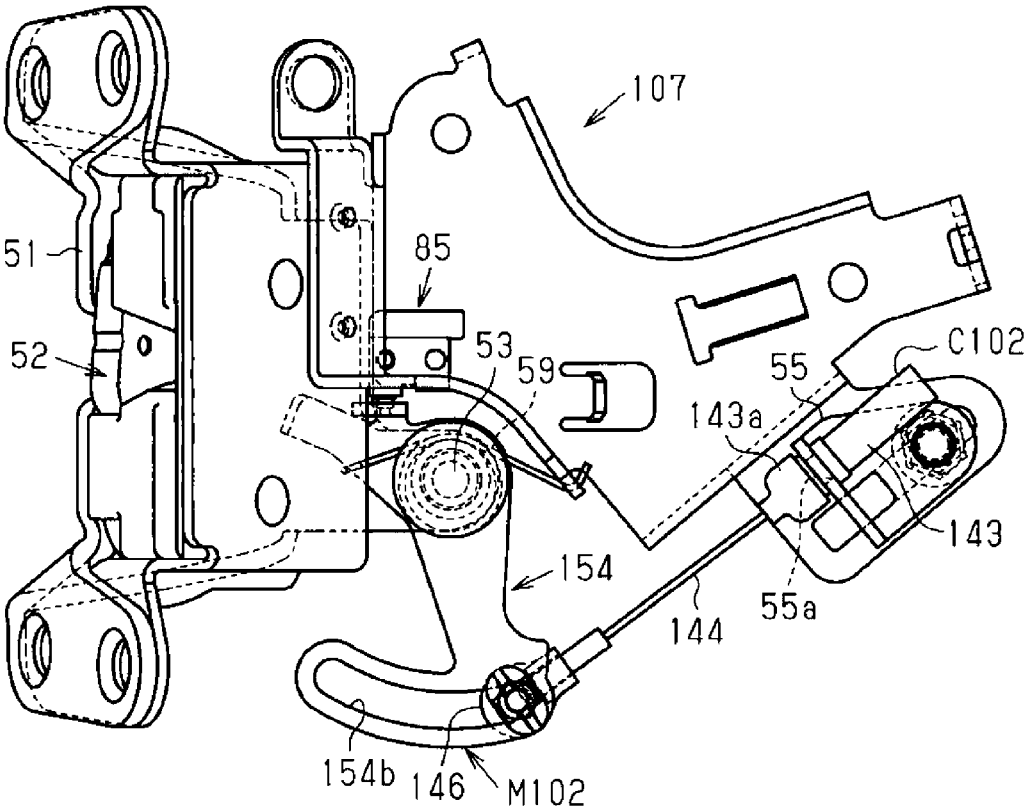
FIG. 16 is a side view illustrating a structure of a front lock of the vehicle door opening/closing device according to the second embodiment.

Meanwhile, as illustrated in FIG. 16, an approximately arc-shaped elongated hole 154*b* as an elongated hole that extends in a circumferential direction around the support pin 53 is formed to penetrate an open lever 154 of a front lock 107 of the present embodiment. A terminal of the release cable C102 is latched in the elongated hole 154*b* of the open lever 154. That is, a terminal 143*a* of the guide tube 143 of the release cable C102 is fitted into the cable locking portion 55*a* and a sliding portion 146, into which a distal end of the internal cable 144 exposed from the terminal 143*a* is inserted, is inserted to be able to slide along the elongated hole 154*b*. When the open lever 154 is at the initial position thereof as illustrated in FIG. 16, the sliding portion 146 is disposed at a terminal end of the elongated hole 154*b* that is on the support bracket 55 side.

Accordingly, when the internal cable 144 is drawn into the guide tube 143, that is, when the internal cable 144 is pulled toward the remote controller 5 side, the open lever 154 rotates in the counter-clockwise direction in the drawing around the support pin 53 from the initial position to the releasing operation position. At this time, the slide door 2 that is held in the fully-closed state (closed state) by the latch mechanism 52 is released and the slide door 2 enters the openable state as described above. A circumferential edge portion of the elongated hole 154*b* that is pulled by the sliding portion 146 when the fully closing lock releasing lever 163 rotates is formed with a thick portion (not shown) equivalent to the thick portion 69.

The normal operation of the present embodiment is the same as that of the first embodiment. Therefore, the description thereof will be omitted.

Here, the description will be made on an assumption that the open lever 32 of the rear lock 6 is bound at the releasing operation position due to rust or the like with the slide door 2 being in the closed state. In this case, as with the first embodiment, the fully closing lock releasing lever 163 rotates (returns) in the second rotation direction around the support shaft 71 up to the original position while the sliding portion 45 of the internal cable 42 pressed toward the remote controller 5 side slides within an area of the elongated hole 163*c* (refer to FIG. 10).

When the fully closing lock releasing lever 163 returns to the original position, the open lever 154 of the front lock 107 returns to the initial position while being urged by the return spring 59. Accordingly, the latch mechanism 52 of the front lock 107 becomes able to hold the slide door 2 in the fully-closed state (closed state). The elongated hole 163*c* and the sliding portion 45 constitute a lost motion mechanism M101 that allows the open lever 154 of the front lock 107 to return to the initial position when the open lever 32 of the rear lock 6 is bound at the releasing operation position. It is a matter of course that the lost motion mechanism M101 is disposed on the fully closing lock releasing lever 63 side (remote controller 5 side) of the release cable C1.

Figure 17:
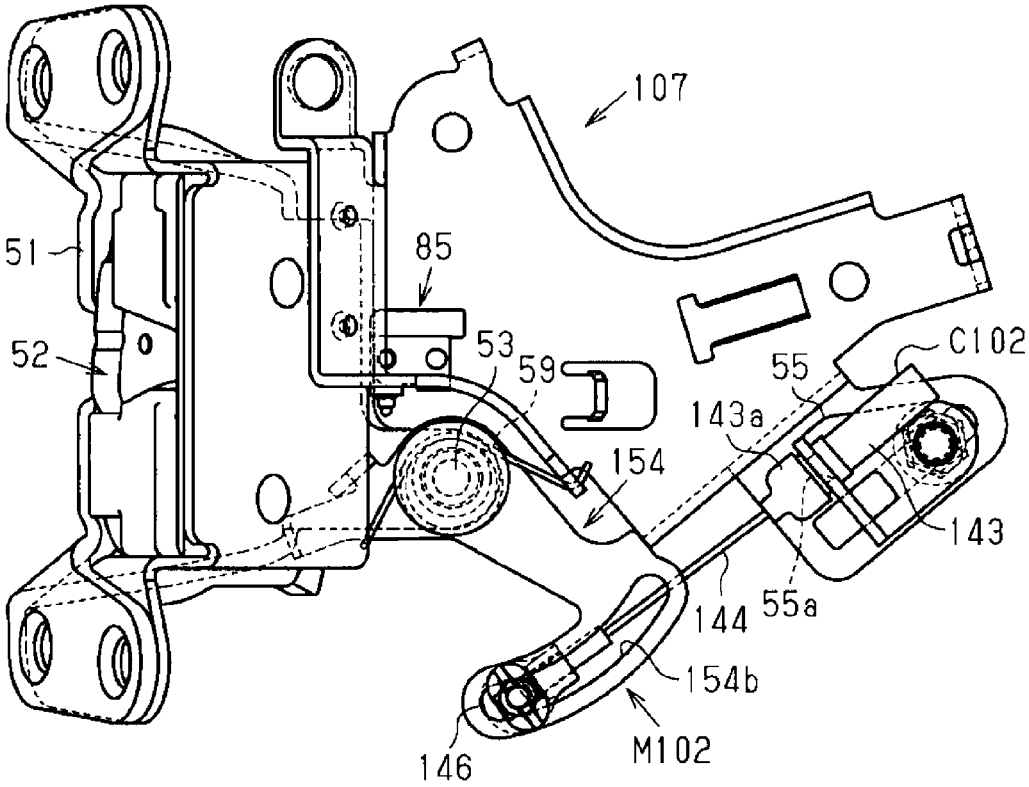
FIG. 17 is a side view illustrating an operation of a lost motion mechanism of the vehicle door opening/closing device according to the second embodiment.

Meanwhile, the description will be made on an assumption that the open lever 154 of the front lock 107 is bound at the releasing operation position due to rust or the like with the slide door 2 being in the closed state as illustrated in FIG. 17. At this time, the latch mechanism 52 of the front lock 107 is held in the unlatched state and the slide door 2 cannot be held in the fully-closed state.

The fully closing lock releasing lever 163 that receives the urging force of the torsion coil spring 73 via the relay lever 62 rotates (returns) in the second rotation direction around the support shaft 71 up to the original position while the sliding portion 146 of the internal cable 144 slides within an area of the elongated hole 154*b*. That is, since the open lever 154 is provided with the elongated hole 154*b* that extends in a direction in which the internal cable 144 is drawn, power that inhibits the fully closing lock releasing lever 163 from returning to the original position is not transmitted to the fully closing lock releasing lever 163.

When the fully closing lock releasing lever 163 returns to the original position, the open lever 32 of the rear lock 6 returns to the initial position while being urged by the return spring 39. Accordingly, the latch mechanism 22 of the rear lock 6 becomes able to hold the slide door 2 in the fully-closed state or the half-closed state (closed state). The elongated hole 154*b* and the sliding portion 146 constitute a lost motion mechanism M102 that allows the open lever 32 of the rear lock 6 to return to the initial position when the open lever 154 of the front lock 107 is bound at the releasing operation position. It is a matter of course that the lost motion mechanism M102 is disposed on the open lever 154 side (door lock device side) of the release cable C102.

As described above, according to the present embodiment, the following effects can be achieved in addition to the effects of the first embodiment.

(1) In the present embodiment, one lost motion mechanism M101 is disposed on the fully closing lock releasing lever 163 side of the release cable C1 and the other lost motion mechanism M102 is disposed on the open lever 154 side of the release cable C102. Accordingly, the degree of freedom in disposing the plurality of lost motion mechanisms M101 and M102 can be increased in comparison with a case where the lost motion mechanisms are disposed to be concentrated on the fully closing lock releasing lever 163 side, for example.

(2) In the present embodiment, the fully closing lock releasing lever 163 is formed with the latching hole 163*e* instead of the elongated hole 63*d*. Therefore, it is possible to achieve reduction in size in a circumferential direction around the support shaft 71. In addition, it is possible to reduce the size of the fully closing lock releasing lever 163 itself or the size of a space necessary for rotation of the fully closing lock releasing lever 163.

Particularly, positioning the latching hole 163*e* radially outward of the elongated hole 163*c* is effective in reducing the size of the fully closing lock releasing lever 163 itself or the size of a space necessary for rotation of the fully closing lock releasing lever 163.

Third Embodiment

Hereinafter, a third embodiment of the vehicle door opening/closing device will be described. The third embodiment is obtained by changing the first embodiment such that a lost motion mechanism is realized by dividing the fully closing lock releasing member (fully closing lock releasing lever) in the first embodiment into two parts. Therefore, detailed description on the same parts as those in the first embodiment will be omitted. Regarding a component in the third embodiment that has the same function as that in the first embodiment, values of the ten's digit and the one's digit of a reference numeral are the same as those in the first embodiment.

Figure 18:
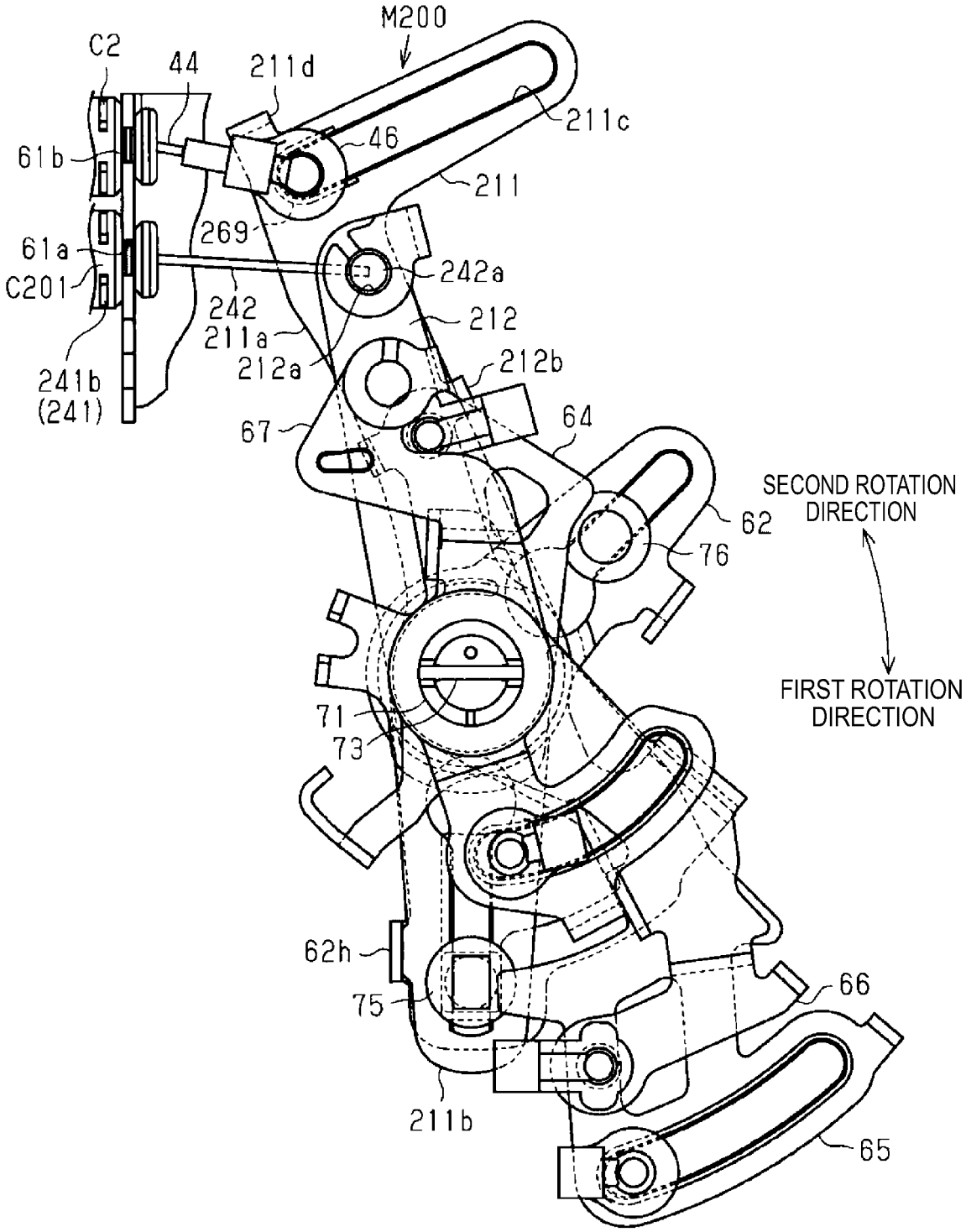
FIG. 18 is a side view illustrating a structure of the remote controller of the vehicle door opening/closing device according to the second embodiment.

As illustrated in FIG. 18, a first fully closing lock releasing lever 211 and a second fully closing lock releasing lever 212, which replace the fully closing lock releasing lever 63 in the first embodiment, are stacked to be arranged in this order from a side close to the base plate 61 and are rotatably supported by the support shaft 71. The first fully closing lock releasing lever 211 and the second fully closing lock releasing lever 212 constitute a fully closing lock releasing member.

The first fully closing lock releasing lever 211 is provided with a pair of lever protruding pieces 211*a* and 211*b*, the lever protruding pieces 211*a* and 211*b* projecting in opposite radial directions centered on the support shaft 71. An approximately linear elongated hole 211*c* as an elongated hole that extends in a direction approximately orthogonal to one radial direction centered on the support shaft 71 is formed to penetrate a distal end portion of one lever protruding piece 211*a* that protrudes toward the same side as the vehicle internal handle connection lever 64.

A terminal of the release cable C2 is latched in the elongated hole 211*c* of the first fully closing lock releasing lever 211. That is, the sliding portion 46 of the internal cable 44 of the release cable C2 is inserted to be able to slide along the elongated hole 211*c*. A distal end of a circumferential edge portion of the elongated hole 211*c* that is on a forward side in the second rotation direction is formed with a thick portion 269 that is equivalent to the thick portion 69.

The connection pin 75 is inserted into the other lever protruding piece 211*b* of the first fully closing lock releasing lever 211 and the connection pin 75 is supported therein. Here, a side edge portion of the lever protruding piece 211*b* of the first fully closing lock releasing lever 211 that faces the first rotation direction can abut onto the interlock abutting piece 62*h* of the relay lever 62. Accordingly, the first fully closing lock releasing lever 211 receives an urging force of the torsion coil spring 73 via the relay lever 62 and is urged in the second rotation direction. In addition, normally, both of the first fully closing lock releasing lever 211 and the relay lever 62 are positioned at the original positions illustrated in FIG. 18 with a stopper portion 211*d* abutting onto the base plate 61, the stopper portion 211*d* being provided on the distal end portion of the lever protruding piece 211*a*. In addition, when the relay lever 62 rotates, the first fully closing lock releasing lever 211 can be integrally rotated via the connection pin 75.

The second fully closing lock releasing lever 212 is molded to have an arm-like shape that extends along the lever protruding piece 211*a* and an approximately circular latching hole 212*a* that penetrates a distal end portion of the second fully closing lock releasing lever 212 in a thickness direction is formed to penetrate the distal end portion. A terminal of a release cable C201 equivalent to the release cable C1 is latched in the latching hole 212*a* of the second fully closing lock releasing lever 212. That is, the release cable C201 is provided with a guide tube 241 that is routed between the rear lock 6 and the release cable C201 and an internal cable 242 that is inserted into the guide tube 241. In addition, a terminal 241*b* of the guide tube 241 is fitted into the cable locking portion 61*a* and an approximately columnar terminal 242*a* of the internal cable 242 exposed from the terminal 241*b* is inserted into and latched in the latching hole 212*a*.

The way in which a terminal of the release cable C201 is latched with respect to the open lever 32 of the rear lock 6 is the same as that in the first embodiment (refer to FIG. 2).

From a side edge portion of the second fully closing lock releasing lever 212 that faces the first rotation direction, an interlock abutting piece 212*b* is bent and raised up toward the first fully closing lock releasing lever 211 side (back side in drawing) at the right angle. The interlock abutting piece 212*b* can abut onto a side edge portion of the lever protruding piece 211*a* that faces the first rotation direction. Therefore, when the first fully closing lock releasing lever 211 is integrally rotated with the relay lever 62 in the first rotation direction from the original position, the second fully closing lock releasing lever 212 whose interlock abutting piece 212*b* is pressed by the first fully closing lock releasing lever 211 is integrally rotated in the first rotation direction from the original position illustrated in FIG. 18. That is, the second fully closing lock releasing lever 212 is rotated in the first rotation direction by being driven by the first fully closing lock releasing lever 211.

Accordingly, the second fully closing lock releasing lever 212 receives an urging force of the return spring 39 of the rear lock 6 via the release cable C201 and is urged in the second rotation direction, for example. In addition, normally, the second fully closing lock releasing lever 212 is positioned at the original position illustrated in FIG. 18 with the interlock abutting piece 212*b* abutting onto the first fully closing lock releasing lever 211 that is at the original position.

The operation of the present embodiment will be described.

When the vehicle external operation handle 3 or the vehicle internal operation handle 4 is operated (opening operation) to apply a releasing operation force or the release actuator 9 is driven to generate a releasing operation force with the slide door 2 being in the fully-closed state, the relay lever 62 rotates in the first rotation direction as described above.

The rotation of the relay lever 62 is transmitted to the first fully closing lock releasing lever 211 via the connection pin 75 and the first fully closing lock releasing lever 211 is integrally rotated with the relay lever 62 in the first rotation direction around the support shaft 71 from the original position. Accordingly, the internal cable 44 of the release cable C2 is pulled toward the remote controller 5 side along with the sliding portion 46 and the open lever 54 is rotated around the support pin 53 toward the releasing operation position from the initial position.

In addition, the rotation of the first fully closing lock releasing lever 211 is transmitted to the second fully closing lock releasing lever 212 via the interlock abutting piece 212*b* and the second fully closing lock releasing lever 212 is integrally rotated with the first fully closing lock releasing lever 211 in the first rotation direction around the support shaft 71 from the original position. Accordingly, the internal cable 242 of the release cable C201 is pulled toward the remote controller 5 side along with the terminal 242*a* and the open lever 32 is rotated around the support pin 53 toward the releasing operation position from the initial position.

Accordingly, the slide door 2 that is held in the fully-closed state or the half-closed state (closed state) by the latch mechanism 22 of the rear lock 6 is released and the slide door 2 that is held in the fully-closed state (closed state) by the latch mechanism 52 of the front lock 7 is released as described above such that the slide door 2 enters the openable state.

Here, the description will be made on an assumption that the open lever 32 of the rear lock 6 is bound at the releasing operation position due to rust or the like with the slide door 2 being in the closed state (refer to FIG. 8). At this time, the latch mechanism 22 of the rear lock 6 is held in the unlatched state and the slide door 2 cannot be held in the fully-closed state or the half-closed state (closed state). In addition, the open lever 32 stuck at the releasing operation position continuously presses the internal cable 242 toward the remote controller 5 side.

Figure 19:
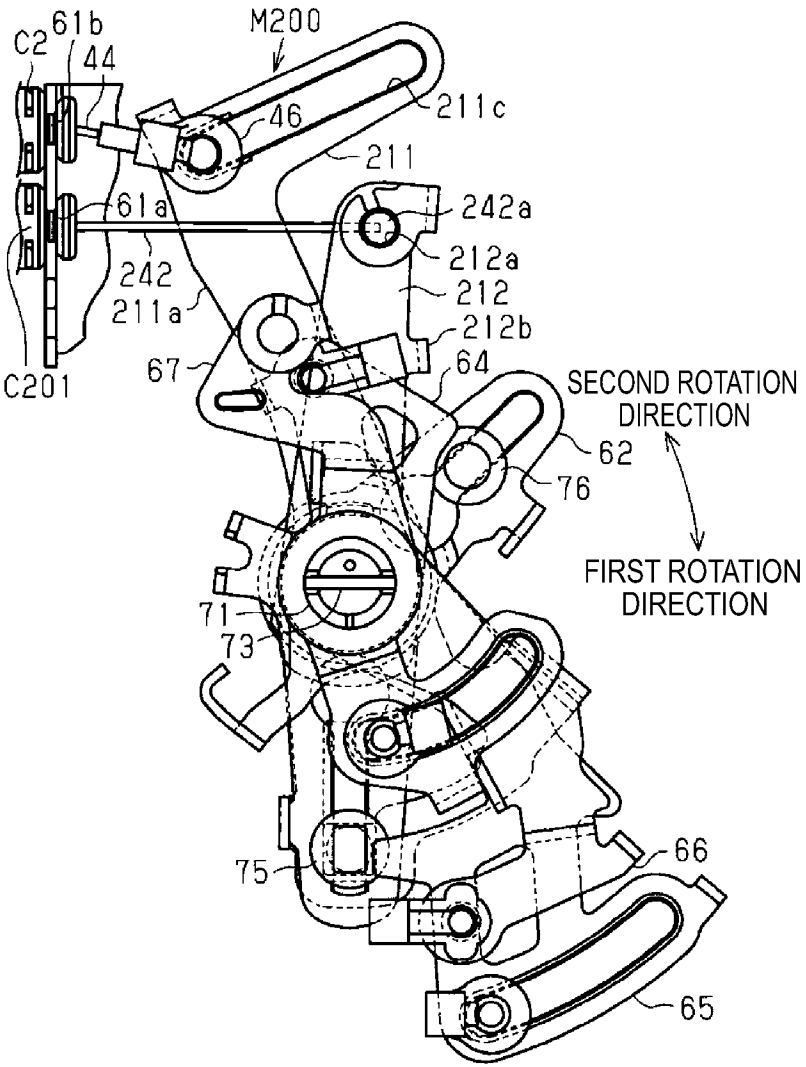
FIG. 19 is a side view illustrating an operation of the lost motion mechanism of the vehicle door opening/closing device according to the second embodiment.

At this time, as illustrated in FIG. 19, the second fully closing lock releasing lever 212 is pressed by the internal cable 242 and maintains a state after rotation in the first rotation direction from the original position. However, the first fully closing lock releasing lever 211 that receives the urging force of the torsion coil spring 73 via the relay lever 62 rotates (returns) in the second rotation direction around the support shaft 71 up to the original position.

When the first fully closing lock releasing lever 211 returns to the original position, the open lever 54 of the front lock 7 returns to the initial position while being urged by the return spring 59. Accordingly, the latch mechanism 52 of the front lock 7 becomes able to hold the slide door 2 in the fully-closed state (closed state).

Meanwhile, the description will be made on an assumption that the open lever 54 of the front lock 7 is bound at the releasing operation position due to rust or the like with the slide door 2 being in the closed state (refer to FIG. 9). At this time, the latch mechanism 52 of the front lock 7 is held in the unlatched state and the slide door 2 cannot be held in the fully-closed state. In addition, the open lever 54 stuck at the releasing operation position continuously presses the internal cable 44 toward the remote controller 5 side.

Figure 20:
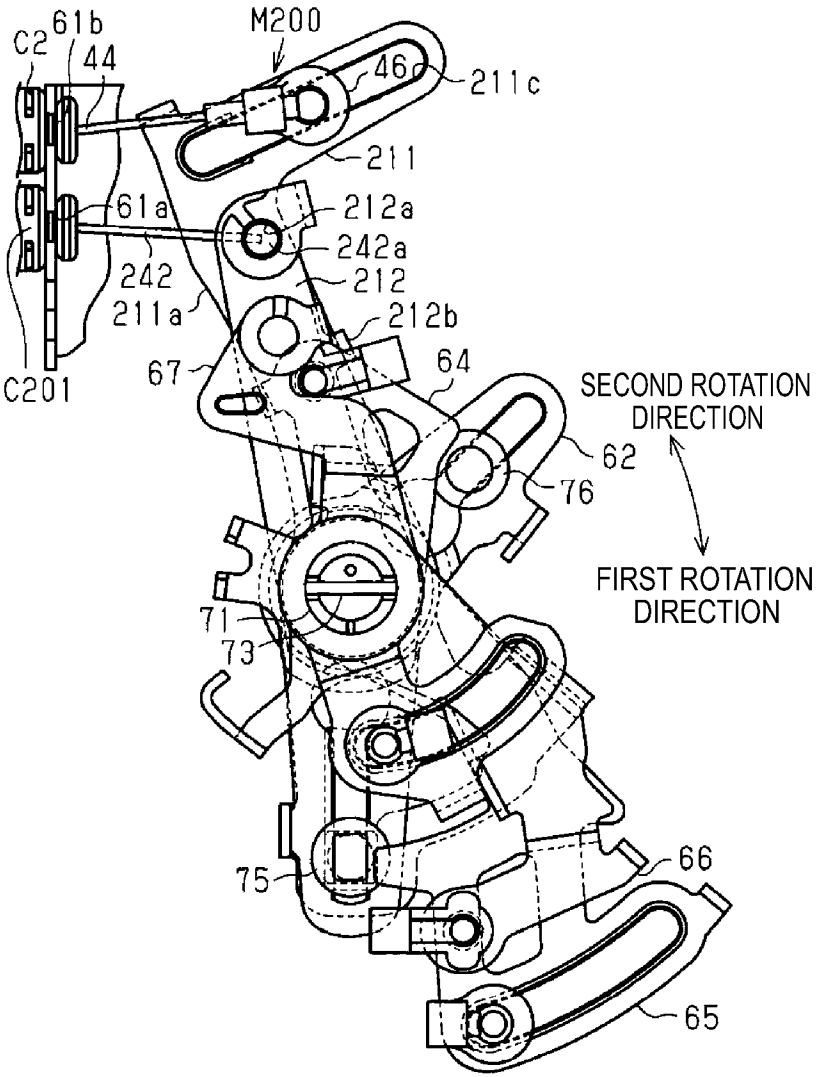
FIG. 20 is a side view illustrating an operation of a fully closing lock releasing lever of the vehicle door opening/closing device according to the second embodiment.

At this time, as illustrated in FIG. 20, the first fully closing lock releasing lever 211 that receives the urging force of the torsion coil spring 73 via the relay lever 62 rotates (returns) in the second rotation direction around the support shaft 71 up to the original position while the sliding portion 46 of the internal cable 44 pressed toward the remote controller 5 side slides within an area of the elongated hole 211*c*. That is, even when the internal cable 44 is pressed toward the remote controller 5 side by the open lever 54, since the elongated hole 211*c* extends in a direction in which the internal cable 44 is pressed, power that inhibits the first fully closing lock releasing lever 211 from returning to the original position is not transmitted to the first fully closing lock releasing lever 211.

When the first fully closing lock releasing lever 211 returns to the original position, the second fully closing lock releasing lever 212 that receives an urging force of the return spring 39 of the rear lock 6 via the release cable C201 rotates (returns) in the second rotation direction around the support shaft 71 up to the original position. At the same time, the open lever 32 of the rear lock 6 returns to the initial position while being urged by the return spring 39. Accordingly, the latch mechanism 22 of the rear lock 6 becomes able to hold the slide door 2 in the fully-closed state or the half-closed state (closed state). The first fully closing lock releasing lever 211 and the second fully closing lock releasing lever 212 driven by the first fully closing lock releasing lever 211 constitute the fully closing lock releasing member and the elongated hole 211*c* and the sliding portion 46 constitute a lost motion mechanism M200 that allows any one of the open levers 32 and 54 to return to the initial position when the other of the open levers 32 and 54 of the rear lock 6 and the front lock 7 is bound at the releasing operation position. It is a matter of course that the lost motion mechanism M200 is disposed on the first and second fully closing lock releasing levers 211 and 212 side (remote controller 5 side) of the release cables C201 and C2.

As described above, according to the present embodiment, the following effects can be achieved in addition to the effect of (5) in the first embodiment.

(1) In the present embodiment, even in a state where any one of the open levers 32 and 54 of the rear lock 6 and the front lock 7 is bound at the releasing operation position with the slide door 2 being in the fully-closed state (closed state), the other of the open levers 32 and 54 of the rear lock 6 and the front lock 7 is allowed to return to the initial position since the lost motion mechanism 200 is provided. Therefore, even if any one of the latch mechanisms 22 and 52 of the rear lock 6 and the front lock 7 cannot hold the slide door 2 in the fully-closed state (closed state), the other of the latch mechanisms 22 and 52 of the rear lock 6 and the front lock 7 can hold the slide door 2 in the fully-closed state (closed state).

(2) In the present embodiment, a force by which the sliding portion 46 clamps the circumferential edge portion of the elongated hole 211*c* is increased as much as the thick portion 269 is thickened. That is, the sliding of the sliding portion 46 is relatively suppressed at the thick portion 269. Therefore, it is possible to restrain the open lever 54 from deviating from the initial position thereof with the sliding portion 46 of the release cable C2 sliding within the elongated hole 211*c*.

In addition, since the practical thickness of the thick portion 269 is set to be large through half blanking molding, it is possible to decrease the number of manufacturing processes in comparison with a case where the thickness is increased by using a resin mold through insert molding or the like and it is possible to achieve a decrease in cost.

(3) In the present embodiment, the open lever 54 of the front lock 7 is urged to rotate toward the initial position by the return spring 59. Therefore, it is possible to further restrain the open lever 54 from deviating from the initial position thereof with the sliding portion 46 of the release cable C2 sliding within the elongated hole 211*c*.

The present embodiment can be implemented by being modified as follows. The present embodiment and the following modification example can be implemented by being combined with each other as long as there is no technical conflict.

- In the first embodiment, the terminals of the release cables C1 and C2 are latched in the elongated holes 63*c* and 63*d*, respectively. However, the relationship thereof may be vice versa.
- In the second embodiment, the latching hole 163*e* is disposed at a position close to the outer circumference of the elongated hole 163*c*. However, the relationship thereof may be vice versa.
- In the second embodiment, the lost motion mechanism M102 is disposed on the front lock 107 side. However, instead of this, the lost motion mechanism may be disposed on the rear lock 6 side.
- In the first and second embodiments, the number of door lock devices (rear lock 6 or like) that hold the slide door 2 in the closed state may be three or more as long as at least one of the plurality of lost motion mechanisms is disposed on the fully closing lock releasing lever (163) side of the plurality of release cables (cables).
- In the third embodiment, the second fully closing lock releasing lever 212 may be held at (may return to) the original position while receiving an urging force of the torsion coil spring 73 via the relay lever 62 independently of the first fully closing lock releasing lever 211, for example.
- In the third embodiment, the open lever 54 of the front lock 7 is connected to the first fully closing lock releasing lever 211 via the release cable C2 and the open lever 32 of the rear lock 6 is connected to the second fully closing lock releasing lever 212 via the release cable C201. However, the relationship thereof may be vice versa. That is, the open lever 32 of the rear lock 6 may be connected to the first fully closing lock releasing lever 211 and the open lever 54 of the front lock 7 may be connected to the second fully closing lock releasing lever 212.
- In each embodiment, the front lever switch 85, the notification unit 91, and the like may be omitted, for example. That is, the electronic control device 90 may not determine whether the front locks 7 and 107 are in an abnormal state and may not notify that the front locks 7 and 107 are in an abnormal state.
- In each embodiment, the return springs 39 and 59 may be omitted.
- In each embodiment, the thick portions 68, 69, 168, and 269 whose thicknesses are increased by using a resin mold through insert molding or the like may be adopted, for example.
- In each embodiment, the thick portions 68, 69, 168, and 269 may be omitted.
- In each embodiment, each of the elongated holes 63*c*, 63*d*, 163*c*, and 211*c* may extend to form an arc shape centered on a rotation shaft thereof.
- In each embodiment, each of the elongated holes 63*c*, 63*d*, 154*b*, 163*c*, and 211*c* may be a non-through hole.
- In each embodiment, the release actuator 9 may be omitted.
- In each embodiment, the rear lock 6 may be provided with a device (so-called door closer device) that closes the slide door 2 such that the slide door 2 in the half-closed state enters the fully-closed state.
- In each embodiment, a swing door may be adopted instead of the slide door 2.

A vehicle door opening/closing device according to an aspect of the disclosure includes: a plurality of door lock devices each of which is installed in a door of a vehicle and includes a latch mechanism that is capable of holding the door in a closed state and an open lever that is capable of transmitting a releasing operation force to the latch mechanism when the open lever rotates from an initial position to a releasing operation position, the releasing operation force being a force that releases the door held by the latch mechanism; a fully closing lock releasing member that is rotatably provided in the door while being linked to an operation handle and that rotates based on the releasing operation force applied to the operation handle; a plurality of cables whose both terminals are connected to the open levers of the plurality of door lock devices and the fully closing lock releasing member and that cause the open levers to rotate to the releasing operation positions from the initial positions when the fully closing lock releasing member rotates; and a plurality of lost motion mechanisms at least one of which is disposed on the fully closing lock releasing member side of the plurality of cables and that, when one of the open levers of the plurality of door lock devices is bound at the releasing operation position, allow the remainder of the open levers of the plurality of door lock devices to return to the initial position.

According to this configuration, even in a state where one of the open levers of the plurality of door lock devices is bound at the releasing operation position with the door being in the closed state, the remainder of the open levers of the plurality of door lock devices is allowed to return to the initial position since the plurality of lost motion mechanisms are provided. Therefore, even if the latch mechanism of some of the plurality of door lock devices becomes not able to hold the door in the closed state, the remainder of the latch mechanisms of the plurality of door lock devices can hold the door in the closed state.

In the vehicle door opening/closing device, it is preferable that each of the plurality of lost motion mechanisms is includes an elongated hole that is formed in any one of the open lever of each of the plurality of door lock devices and a fully closing lock releasing lever as the fully closing lock releasing member, and a sliding portion that is provided at the terminal of each of the cables and connects the terminal to the corresponding open lever or the fully closing lock releasing lever such that the sliding portion is inserted to be able to slide along the elongated hole.

According to this configuration, in a case where one of the open levers of the plurality of door lock devices is bound at the releasing operation position, the fully closing lock releasing lever is not restricted by the open lever and can perform returning rotation since the sliding portion of the cable connected to the open lever slides within an area of the elongated hole. Accordingly, the remainder of the open levers of the plurality of door lock devices is allowed to return to the initial position. As described above, it is possible to extremely simplify the configuration of the lost motion mechanism by using the elongated hole and the sliding portion.

In the vehicle door opening/closing device, it is preferable that the sliding portion is inserted into the elongated hole to clamp a circumferential edge portion of the elongated hole, and the circumferential edge portion of the elongated hole that is pulled by the sliding portion when the fully closing lock releasing member rotates is formed with a thick portion whose thickness is larger than a thickness of a circumferential edge portion of the elongated hole other than the thick portion.

According to this configuration, a force by which the sliding portion clamps the circumferential edge portion of the elongated hole is increased as much as the thick portion is thickened. That is, the sliding of the sliding portion is relatively suppressed at the thick portion. Therefore, it is possible to restrain the open lever from deviating from the initial position thereof with the sliding portion of the cable sliding within the elongated hole.

It is preferable that the vehicle door opening/closing device further includes a plurality of return springs that urge the open levers of the plurality of door lock devices such that the open levers rotate to the initial positions.

According to this configuration, the open levers of the plurality of door lock devices are urged to rotate toward the initial positions by the return springs, respectively. Therefore, it is possible to further restrain the open lever from deviating from the initial position thereof with the sliding portion of the cable sliding within the elongated hole.

In the vehicle door opening/closing device, it is preferable that at least one of the plurality of lost motion mechanisms is disposed on the open lever side of the plurality of cables.

According to this configuration, the plurality of lost motion mechanisms are disposed on the fully closing lock releasing lever (fully closing lock releasing member) side and the open lever side of the plurality of cables. Accordingly, the degree of freedom in disposing the plurality of lost motion mechanisms can be increased.

A vehicle door opening/closing device according to another aspect of the disclosure includes: a plurality of door lock devices each of which is installed in a door of a vehicle and includes a latch mechanism that is capable of holding the door in a closed state and an open lever that is capable of transmitting a releasing operation force to the latch mechanism when the open lever rotates from an initial position to a releasing operation position, the releasing operation force being a force that releases the door held by the latch mechanism; a fully closing lock releasing member that is rotatably provided in the door while being linked to an operation handle and that rotates based on the releasing operation force applied to the operation handle; a plurality of cables whose both terminals are connected to the open levers of the plurality of door lock devices and the fully closing lock releasing member and that cause the open levers to rotate to the releasing operation positions from the initial positions when the fully closing lock releasing member rotates; and a lost motion mechanism that is disposed on the fully closing lock releasing member side of the plurality of cables and that, when one of the open levers of the plurality of door lock devices is bound at the releasing operation position, allows the remainder of the open levers of the plurality of door lock devices to return to the initial position.

According to this configuration, even in a state where one of the open levers of the plurality of door lock devices is bound at the releasing operation position with the door being in the closed state, the remainder of the open levers of the plurality of door lock devices is allowed to return to the initial position since the lost motion mechanism is provided. Therefore, even if the latch mechanism of some of the plurality of door lock devices becomes not able to hold the door in the closed state, the remainder of the latch mechanisms of the plurality of door lock devices can hold the door in the closed state.

In the vehicle door opening/closing device, it is preferable that the number of the door lock devices is two, the fully closing lock releasing member is configured of a first fully closing lock releasing lever that is connected to any one of the open levers of the two door lock devices via the cable and a second fully closing lock releasing lever that is connected to the other of the open levers of the two door lock devices via the cable and that is driven by the first fully closing lock releasing lever, and the lost motion mechanism includes an elongated hole formed in the first fully closing lock releasing lever and a sliding portion that is provided at the terminal of the cable connected to the first fully closing lock releasing lever and is inserted to be able to slide along the elongated hole.

In the vehicle door opening/closing device, it is preferable that the plurality of door lock devices are a rear lock and a front lock, and the vehicle door opening/closing device further includes a first switch that detects whether the door is held in the closed state by the latch mechanism of the rear lock, a second switch that detects whether the open lever of the front lock is at the initial position, a determination unit that determines that the front lock is in an abnormal state when the first switch detects that the door is held in the closed state by the latch mechanism of the rear lock and the second switch detects that the open lever of the front lock is not at the initial position, and a notification unit that performs notification when the determination unit determines that the front lock is in the abnormal state.

Normally, in a state where the latch mechanism of the rear lock holds the door in the closed state, the latch mechanism of the front lock also holds the door in the closed state such that the open lever of the front lock is positioned at the initial position. According to this configuration, when the first switch detects that the door is held in the closed state by the latch mechanism of the rear lock and the second switch detects that the open lever of the front lock is not at the initial position, the determination unit determines that the front lock is in the abnormal state and the notification unit performs notification. Accordingly, it is possible to reduce a possibility that a state where the door is held in the closed state by only the latch mechanism of the rear lock meaninglessly continues.

According to this disclosure, it is possible to achieve an effect that even if a latch mechanism of some of a plurality of door lock devices becomes not able to hold a door in a closed state, the remainder of the latch mechanisms of the plurality of door lock devices can hold the door in the closed state.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle door opening/closing device comprising:

a plurality of door lock devices each of which is installed in a door of a vehicle and includes a latch mechanism that is capable of holding the door in a closed state and an open lever that is capable of transmitting a releasing operation force to the latch mechanism when the open lever rotates from an initial position to a releasing operation position, the releasing operation force being a force that releases the door held by the latch mechanism;

a fully closing lock releasing member that is rotatably provided in the door while being linked to an operation handle and that rotates based on the releasing operation force applied to the operation handle;

a plurality of cables whose both terminals are connected to the open levers of the plurality of door lock devices and the fully closing lock releasing member and that cause the open levers to rotate to the releasing operation positions from the initial positions when the fully closing lock releasing member rotates; and a plurality of lost motion mechanisms at least one of which is disposed on the fully closing lock releasing member side of the plurality of cables, wherein, when the open lever of one of the plurality of door lock devices is bound at the releasing operation position due to a malfunction, the open levers of the remainder of the plurality of door lock devices are allowed to return to the initial position by a restoring mechanism operatively acting on the fully closing lock releasing lever, allowing another one of the plurality of door lock devices to hold the door in the closed state.

2. The vehicle door opening/closing device according to claim 1, wherein each of the plurality of lost motion mechanisms includes an elongated hole that is formed in any one of the open lever of each of the plurality of door lock devices and a fully closing lock releasing lever as the fully closing lock releasing member, and a sliding portion that is provided at the terminal of each of the cables and connects the terminal to the corresponding open lever or the fully closing lock releasing lever such that the sliding portion is inserted to be able to slide along the elongated hole.

3. The vehicle door opening/closing device according to claim 2, wherein the sliding portion is inserted into the elongated hole to clamp a circumferential edge portion of the elongated hole, and the circumferential edge portion of the elongated hole that is pulled by the sliding portion when the fully closing lock releasing member rotates is formed with a thick portion whose thickness is larger than a thickness of a circumferential edge portion of the elongated hole other than the thick portion.

4. The vehicle door opening/closing device according to claim 2, further comprising:

a plurality of return springs that urge the open levers of the plurality of door lock devices such that the open levers rotate to the initial positions.

5. The vehicle door opening/closing device according to claim 3, further comprising:

a plurality of return springs that urge the open levers of the plurality of door lock devices such that the open levers rotate to the initial positions.

6. The vehicle door opening/closing device according to claim 2, wherein at least one of the plurality of lost motion mechanisms is disposed on the open lever side of the plurality of cables.

7. The vehicle door opening/closing device according to claim 3, wherein at least one of the plurality of lost motion mechanisms is disposed on the open lever side of the plurality of cables.

8. The vehicle door opening/closing device according to claim 4, wherein at least one of the plurality of lost motion mechanisms is disposed on the open lever side of the plurality of cables.

9. The vehicle door opening/closing device according to claim 5, wherein at least one of the plurality of lost motion mechanisms is disposed on the open lever side of the plurality of cables.

10. A vehicle door opening/closing device comprising:

a plurality of door lock devices each of which is installed in a door of a vehicle and includes a latch mechanism that is capable of holding the door in a closed state and an open lever that is capable of transmitting a releasing operation force to the latch mechanism when the open lever rotates from an initial position to a releasing operation position, the releasing operation force being a force that releases the door held by the latch mechanism;

a fully closing lock releasing member that is rotatably provided in the door while being linked to an operation handle and that rotates based on the releasing operation force applied to the operation handle;

a plurality of cables whose both terminals are connected to the open levers of the plurality of door lock devices and the fully closing lock releasing member and that cause the open levers to rotate to the releasing operation positions from the initial positions when the fully closing lock releasing member rotates; and a lost motion mechanism that is disposed on the fully closing lock releasing member side of the plurality of cables, wherein, when the open lever of one of the plurality of door lock devices is bound at the releasing operation position due to a malfunction, the open levers of the remainder of the plurality of door lock devices are allowed to return to the initial position by a restoring mechanism operatively acting on the fully closing lock releasing lever, allowing another one of the plurality of door lock devices to hold the door in the closed state.

11. The vehicle door opening/closing device according to claim 10, wherein the number of the door lock devices is two, the fully closing lock releasing member is configured of a first fully closing lock releasing lever that is connected to any one of the open levers of the two door lock devices via the cable and a second fully closing lock releasing lever that is connected to the other of the open levers of the two door lock devices via the cable and that is driven by the first fully closing lock releasing lever, and the lost motion mechanism includes an elongated hole formed in the first fully closing lock releasing lever, and a sliding portion that is provided at the terminal of the cable connected to the first fully closing lock releasing lever and is inserted to be able to slide along the elongated hole.

12. The vehicle door opening/closing device according to claim 1, wherein the plurality of door lock devices are a rear lock and a front lock, and the vehicle door opening/closing device further comprises:

a first switch that detects whether the door is held in the closed state by the latch mechanism of the rear lock;

a second switch that detects whether the open lever of the front lock is at the initial position;

a determination unit that determines that the front lock is in an abnormal state when the first switch detects that the door is held in the closed state by the latch mechanism of the rear lock and the second switch detects that the open lever of the front lock is not at the initial position; and a notification unit that performs notification when the determination unit determines that the front lock is in the abnormal state.

13. The vehicle door opening/closing device according to claim 2, wherein the plurality of door lock devices are a rear lock and a front lock, and the vehicle door opening/closing device further comprises:

a first switch that detects whether the door is held in the closed state by the latch mechanism of the rear lock;

a second switch that detects whether the open lever of the front lock is at the initial position;

a determination unit that determines that the front lock is in an abnormal state when the first switch detects that the door is held in the closed state by the latch mechanism of the rear lock and the second switch detects that the open lever of the front lock is not at the initial position; and a notification unit that performs notification when the determination unit determines that the front lock is in the abnormal state.

14. The vehicle door opening/closing device according to claim 3, wherein the plurality of door lock devices are a rear lock and a front lock, and the vehicle door opening/closing device further comprises:

a first switch that detects whether the door is held in the closed state by the latch mechanism of the rear lock;

a second switch that detects whether the open lever of the front lock is at the initial position;

a determination unit that determines that the front lock is in an abnormal state when the first switch detects that the door is held in the closed state by the latch mechanism of the rear lock and the second switch detects that the open lever of the front lock is not at the initial position; and a notification unit that performs notification when the determination unit determines that the front lock is in the abnormal state.

15. The vehicle door opening/closing device according to claim 4, wherein the plurality of door lock devices are a rear lock and a front lock, and the vehicle door opening/closing device further comprises:

a first switch that detects whether the door is held in the closed state by the latch mechanism of the rear lock;

a second switch that detects whether the open lever of the front lock is at the initial position;

a determination unit that determines that the front lock is in an abnormal state when the first switch detects that the door is held in the closed state by the latch mechanism of the rear lock and the second switch detects that the open lever of the front lock is not at the initial position; and a notification unit that performs notification when the determination unit determines that the front lock is in the abnormal state.

16. The vehicle door opening/closing device according to claim 6, wherein the plurality of door lock devices are a rear lock and a front lock, and the vehicle door opening/closing device further comprises:

a first switch that detects whether the door is held in the closed state by the latch mechanism of the rear lock;

a second switch that detects whether the open lever of the front lock is at the initial position;

a determination unit that determines that the front lock is in an abnormal state when the first switch detects that the door is held in the closed state by the latch mechanism of the rear lock and the second switch detects that the open lever of the front lock is not at the initial position; and a notification unit that performs notification when the determination unit determines that the front lock is in the abnormal state.

17. The vehicle door opening/closing device according to claim 10, wherein the plurality of door lock devices are a rear lock and a front lock, and the vehicle door opening/closing device further comprises:

a first switch that detects whether the door is held in the closed state by the latch mechanism of the rear lock;

a second switch that detects whether the open lever of the front lock is at the initial position;

a determination unit that determines that the front lock is in an abnormal state when the first switch detects that the door is held in the closed state by the latch mechanism of the rear lock and the second switch detects that the open lever of the front lock is not at the initial position; and a notification unit that performs notification when the determination unit determines that the front lock is in the abnormal state.

18. The vehicle door opening/closing device according to claim 11, wherein the plurality of door lock devices are a rear lock and a front lock, and the vehicle door opening/closing device further comprises:

a first switch that detects whether the door is held in the closed state by the latch mechanism of the rear lock;

a second switch that detects whether the open lever of the front lock is at the initial position;

a determination unit that determines that the front lock is in an abnormal state when the first switch detects that the door is held in the closed state by the latch mechanism of the rear lock and the second switch detects that the open lever of the front lock is not at the initial position; and a notification unit that performs notification when the determination unit determines that the front lock is in the abnormal state.

19. A vehicle door opening/closing device comprising:

a plurality of door lock devices each of which is installed in a door of a vehicle and includes a latch mechanism that is capable of holding the door in a closed state and an open lever that is capable of transmitting a releasing operation force to the latch mechanism when the open lever rotates from an initial position to a releasing operation position, the releasing operation force being a force that releases the door held by the latch mechanism;

a fully closing lock releasing lever that is rotatably provided in the door while being linked to an operation handle and that rotates based on the releasing operation force applied to the operation handle;

a plurality of cables each having a first terminal connected to a corresponding open lever of the plurality of door lock devices and a second terminal connected to the fully closing lock releasing lever and that cause the open levers to rotate to the releasing operation positions from the initial positions when the fully closing lock releasing lever rotates; and a plurality of lost motion mechanisms each configured as a connection between a corresponding second terminal of the plurality of cables and the fully closing lock releasing lever so that each of the plurality of lost motion mechanisms independently corresponds to one of the plurality of door lock devices, wherein, when the open lever of one of the plurality of door lock devices is bound at the releasing operation position due to a malfunction, the open levers of the remainder of the plurality of door lock devices are allowed to return to the initial position by a restoring mechanism operatively acting on the fully closing lock releasing lever, allowing another one of the plurality of door lock devices to hold the door in the closed state.

* * * * *